US007364064B2

(12) United States Patent
Kanamori et al.

(10) Patent No.: US 7,364,064 B2
(45) Date of Patent: Apr. 29, 2008

(54) CARTON

(75) Inventors: Shino Kanamori, Saitama-ken (JP); Kazuhiro Tokuda, Saitama-ken (JP)

(73) Assignee: Fujifilm Corporation, Tokyo (JP)

( * ) Notice: Subject to any disclaimer, the term of this patent is extended or adjusted under 35 U.S.C. 154(b) by 8 days.

(21) Appl. No.: 11/312,507

(22) Filed: Dec. 21, 2005

(65) Prior Publication Data

US 2006/0097032 A1 May 11, 2006

Related U.S. Application Data

(62) Division of application No. 10/620,390, filed on Jul. 17, 2003, now Pat. No. 7,036,716.

(30) Foreign Application Priority Data

Jul. 26, 2002 (JP) ..... 2002-218498
Jul. 26, 2002 (JP) ..... 2002-218499
Aug. 26, 2002 (JP) ..... 2002-244673

(51) Int. Cl.
*B65D 5/36* (2006.01)

(52) U.S. Cl. ..... 229/120.21; 206/279; 206/738; 206/817; 229/120.08; 229/120.32; 229/904

(58) Field of Classification Search ..... 229/120.08, 229/120.21, 120.32, 122, 913, 904; 221/279; 206/42.25, 738, 739, 743, 761, 765, 774, 206/804, 817
See application file for complete search history.

(56) References Cited

U.S. PATENT DOCUMENTS

| | | | | |
|---|---|---|---|---|
| 1,029,096 | A | 6/1912 | Wolf | |
| 4,138,052 | A | 2/1979 | Torigian | |
| 4,438,848 | A | 3/1984 | Montealegre et al. | |
| 4,957,237 | A | 9/1990 | Madonna et al. | |
| 5,020,719 | A | 6/1991 | Roth et al. | |
| 5,096,055 | A | 3/1992 | Opper | |
| 5,205,474 | A * | 4/1993 | Stuart et al. | 229/904 |
| 6,168,073 | B1 | 1/2001 | Towle | |
| 6,523,693 | B1 | 2/2003 | Eggenberger et al. | |
| 7,036,716 | B2 * | 5/2006 | Kanamori et al. | 229/120.21 |

FOREIGN PATENT DOCUMENTS

| | | |
|---|---|---|
| JP | 08-091460 | 4/1996 |

* cited by examiner

*Primary Examiner*—Gary E Elkins
(74) *Attorney, Agent, or Firm*—Sughrue Mion, PLLC

(57) ABSTRACT

A carton is disclosed. In this carton, a first connection plate is connected to an upper plate, a second connection plate is connected to the first connection plate, and a partition plate is connected to the second connection plate. When the partition plate is pulled outward from the opening, the partition plate moves in the same direction, and is pulled out.

8 Claims, 33 Drawing Sheets

CARTON

CROSS-REFERENCE TO RELATED APPLICATIONS

This application is a divisional of application Ser. No. 10/620,390 filed on Jul. 17, 2003 now U.S. Pat. No. 7,036,716, which claims priority under 35USC 119 from Japanese Patent Application Nos. 2002-218498, 2002-218499, 2002-244673, the disclosures of which are incorporated herein by reference.

BACKGROUND OF THE INVENTION

1. Field of the Invention

The present invention relates to a carton, and more particularly, to a carton that is used for packaging precision equipment, such as a digital camera.

2. Description of the Related Art

In a carton for packaging precision equipment, such as a digital camera, partition plates, which are formed integrally with a body of the carton, are conventionally used for partitioning a space in the carton into a plurality of sections. For example, in a carton for use as a packaging box described in Japanese Patent Application Laid-Open (JP-A) No. 6-263181, the space in the carton is partitioned into a section for accommodating electronics and a section for accommodating a manual by a partition wall connected to a box body. Further, in a carton described in Japanese Utility Model Application Laid-Open (JP-U) No. 6-69119, the space in the carton is partitioned into a section for accommodating a body of an object to be packaged and a section for accommodating a manual by an inner bottom wall, a first partition plate and a second partition plate, which are connected to a body of the carton. In these cartons, the body and the partition plates (the partition wall, the inner bottom wall, the first partition plate, and the second partition plate) are integrally formed, and therefore, the cartons have advantages in that production thereof is easy and in that a number of parts can be reduced.

However, since the partition plates of the cartons described in the above-cited documents are fixed at predetermined positions, the partition plates cannot be pulled out from, and then pushed into the cartons.

SUMMARY OF THE INVENTION

In view of the foregoing, an object of the present invention is to provide a carton that can be easily produced and is more convenient than conventional cartons. Further, a carton that can be easily produced and has a high buffering effect and convenience is also provided.

In order to accomplish the above-described object, a carton body having an opening through which an object to be packaged can be put in and taken out; a partition plate formed in a plate shape for partitioning a space surrounded by the carton body into a plurality of rooms, the partition plate being movable along a plane thereof outward from the opening; and a connection plate comprising a first connecting portion integrally connected to the carton body and a second connecting portion integrally connected to the partition plate, a distance between the first connecting portion and the second connecting portion being changeable.

In the carton according to the first aspect, a space surrounded by the carton body is partitioned into a plurality of rooms by the partition plate. When a force in a direction along a plane of the partition plate outward from the opening is applied to the partition plate, a force in the same direction is applied to the second connecting portion connected to the partition plate. Here, the direction along the plane of the plate refers to a direction which is substantially parallel with the plane, and includes a direction parallel to the plate plane as well as a direction which is slightly offset from the parallel direction. Since the distance between the first connecting portion connected to the carton body and the second connecting portion of the connection plate is changeable, the partition plate moves in a direction along the plane of the partition plate outward from the opening.

For example, if an object is placed on the partition plate when it is packaged and the object is moved outward from the opening together with the partition plate, the object can be easily taken out from the package, thereby increasing convenience.

In addition, in the carton according to the invention, since the partition plate moves along the plane of the partition plate outward from the opening, the partition plate does not enter the partitioned rooms such as if the partition plate were to move in a direction perpendicular to the plane thereof. Therefore, even when objects are packaged in the partitioned rooms, the partition plate can be easily moved in the above-described direction without removing the objects and/or providing a space for entering the partition plate into each room.

Moreover, since the first connecting portion of the connection plate is integrally connected to the carton body and the second connecting portion of the connection plate is integrally connected to the partition plate, the partition plate, the connection plate and the carton body can be integrally formed. As a result, the carton having the above-described effects can be easily produced, and the number of parts is smaller than that of a carton in which each part is separately formed. Further, this carton can be easily assembled.

The carton of the first aspect may also be characterized in that the carton body, the partition plate and the connection plate are formed from a single plate. By forming these parts from a single plate, production costs can be reduced.

The carton of the first aspect may further include an object moving member integrally connected to at least one of the partition plate and the connection plate, for moving the object accommodated in at least one of the rooms along with movement of the partition plate.

According to the carton having the structure described above, since the object moving member moves the object accommodated in at least one of the rooms along with movement of the partition plate, the object can be easily taken out, thereby increasing convenience. Further, since the object moving member is integrally connected to at least one of the partition plate and the connection plate, the carton can be produced more easily and the number of parts is smaller than when the moving member is separately formed.

In order to move the object by the object moving member, the object may be fixed to at least one of the partition plate and the connection plate. Alternatively, the object may be moved simply by being pushed in the direction of movement without being fixed. It should be noted that, in some cases, the connection plate may also serve as an object moving member.

The carton of the first aspect may further include a cover integrally connected to the carton body, for covering the opening.

According to the carton having the above-described structure, when the objects are packaged in the carton, the objects are accommodated in the respective rooms through the opening, and the opening is covered by the cover. Therefore, the packaged objects are not exposed to the outside and are protected.

A carton according to a second aspect includes: a carton body having an opening through which an object to be packaged can be put in and taken out; a partition plate formed in a plate shape for partitioning a space surrounded by the carton body into a plurality of rooms, the partition plate being movable along a plane thereof outward from the opening; a connection plate comprising a first connecting portion integrally connected to the carton body and a second connecting portion integrally connected to the partition plate, a distance between the first connecting portion and the second connecting portion being changeable; and a handle formed integrally with at least one of the connection plate and the partition plate.

Here, the handle refers to a portion which receives a force applied by a user in a direction along the plane of the partition plate outward from the opening. The user can easily apply the force by hooking his/her finger on or grasping the portion.

In the carton of the second aspect, the space surrounded by the carton body is partitioned into a plurality of rooms. When a force in the direction along the plane of the partition plate outward from the opening is applied to the handle by the user hooking his/her finger on or grasping the handle, a force in the same direction is applied to the partition plate and the second connecting portion connected to the partition plate. Since the distance between the first connecting portion, which is connected to the carton body, and the second connecting portion can change, the partition plate is moved in the direction along the plane of the partition plate outward from the opening.

Since the handle is provided in the above described structure, the user can move the partition plate in the direction along the plane of the partition plate outward from the opening more easily than when the handle is not provided. A force may be applied to the handle using a tool other than fingers. For example, if an object is placed on the partition plate when it is packaged and the object is moved outward from the opening together with the partition plate, the object can be easily taken out from the package, thereby increasing convenience.

Moreover, according to the carton described above, since the partition plate moves along the plane of the partition plate outward from the opening, the partition plate does not enter the partitioned rooms such as if the partition plate were to move in a direction perpendicular to the plane thereof. Therefore, even when objects are packaged in the partitioned rooms, the partition plate can be easily moved in the above-described direction without removing the objects and/or providing a space for entering the partition plate into each room.

Moreover, since the first connecting portion of the connection plate is integrally connected to the carton body, the second connecting portion of the connection plate is integrally connected to the partition plate, and the handle is formed integrally with at least one of the connection plate and the partition plate, the handle, the partition plate, the connection plate and the carton body can be integrally formed. As a result, the carton having the above-described effects can be easily produced, and the number of parts is smaller than that of a carton in which each part is separately formed.

The carton of the second aspect may also be characterized in that the carton body, the partition plate, the handle and the connection plate are formed from a single plate. By forming these parts from a single plate, production costs can be reduced.

The carton of the second aspect may further include an object moving member integrally connected to at least one of the partition plate and the connection plate, for moving the object accommodated in at least one of the rooms along with movement of the partition plate.

According to the carton having the structure described above, since the object moving member moves the object accommodated in at least one of the rooms along with movement of the partition plate, the object can be easily taken out, thereby increasing convenience. Further, since the object moving member is integrally connected to at least one of the partition plate and the connection plate, the carton can be produced more easily and the number of parts is smaller than when the moving member is separately formed.

In order to move the object by the object moving member, the object may be fixed to at least one of the partition plate and the connection plate. Alternatively, the object may be moved simply by being pushed in the direction of movement without being fixed. It should be noted that, in some cases, the connection plate may also serve as an object moving member.

The carton of the second aspect may further include a cover integrally connected to the carton body, for covering the opening.

According to the carton having the above-described structure, when the objects are packaged in the carton, the objects are accommodated in the respective rooms through the opening, and the opening is covered by the cover. Therefore, the packaged objects are not exposed to the outside and are protected.

A carton according to a third aspect includes: a carton body having an opening through which an object to be packaged can be put in and taken out; a partition plate formed in a plate shape for partitioning a space surrounded by the carton body into a plurality of rooms, the partition plate being movable along a plane thereof outward from the opening; a buffer plate connected integrally with the partition plate and disposed between the object accommodated in at least one of the rooms and the carton body, the buffer plate being able to alter when pressed by the object; and a connection plate comprising a first connecting portion integrally connected to the carton body and a second connecting portion integrally connected to the partition plate, a distance between the first connecting portion and the second connecting portion being changeable.

In the carton of the third aspect, the space surrounded by the carton body is partitioned into a plurality of rooms. The buffer plate is formed integrally with the partition plate, and is disposed between the carton body and the object accommodated in the partitioned room. When an impact, or the like, is applied, the buffer plate pressed by the object is altered. This alteration absorbs the impact applied to the object. Here, the alteration refers to movement of the buffer plate such as translation or rotation, and/or partial displacement of the buffer plate such as deformation of the buffer plate.

When a force in the direction along the plane of the partition plate outward from the opening is applied to the partition plate, a force in the same direction is applied to the second connection plate connected to the partition plate. Since the distance between the first connecting portion, which is connected to the carton body, and the second connecting portion can change, the partition plate is moved in the direction along the plane of the partition plate outward from the opening.

According to the above-described structure, the buffer plate can provide a buffer effect. In addition, for example, if the object is placed on the partition plate when it is packaged and the object is moved outward from the opening together with the partition plate, the object can be easily taken out from the package, thereby increasing convenience.

Moreover, according the carton of the invention, since the partition plate moves along the plane of the partition plate outward from the opening, the partition plate does not enter the partitioned rooms such as if the partition plate were to move in a direction perpendicular to the plate plane. Therefore, even when objects are packaged in the partitioned rooms, the partition plate can be easily moved in the above-described direction without removing the objects and/or providing a space for entering the partition plate into each room.

Furthermore, since the first connecting portion of the connection plate is integrally connected to the carton body, the second connecting portion of the connection plate is integrally connected to the partition plate, and the buffer plate is formed integrally with the partition plate, the buffer plate, the partition plate, the connection plate and the carton body can be integrally formed. As a result, the carton having the above-described effects can be easily produced, and the number of parts is smaller than that of a carton in which each part is separately formed.

The carton of the third aspect may also be characterized in that the carton body, the partition plate and the connection plate are formed from a single plate. By forming these parts from a single plate, production costs can be reduced.

The carton of the third aspect may further include an object moving member integrally connected to at least one of the partition plate and the connection plate, for moving the object accommodated in at least one of the rooms along with movement of the partition plate.

According to the carton having the structure described above, since the object moving member moves the object accommodated in at least one of the rooms along with movement of the partition plate, the object can be easily taken out, thereby increasing convenience. Further, since the object moving member is integrally connected to at least one of the partition plate and the connection plate, the carton can be produced more easily and the number of parts is smaller than when the moving member is separately formed.

In order to move the object by the object moving member, the object may be fixed on at least one of the partition plate and the connection plate. Alternatively, the object may be moved simply by being pushed in the direction of movement without being fixed. It should be noted that, in some cases, the connection plate may also serve as an object moving member.

The carton of the third aspect may further include a cover integrally connected to the carton body, for covering the opening.

According to the carton having the above-described structure, when the objects are packaged in the carton, the objects are accommodated in the respective rooms through the opening, and the opening is covered by the cover. Therefore, the packaged objects are not exposed to the outside and are protected.

DESCRIPTION OF THE PREFERRED EMBODIMENTS

First Embodiment

A first embodiment of a carton according to the present invention will now be described with reference to the drawings.

Figure 1:
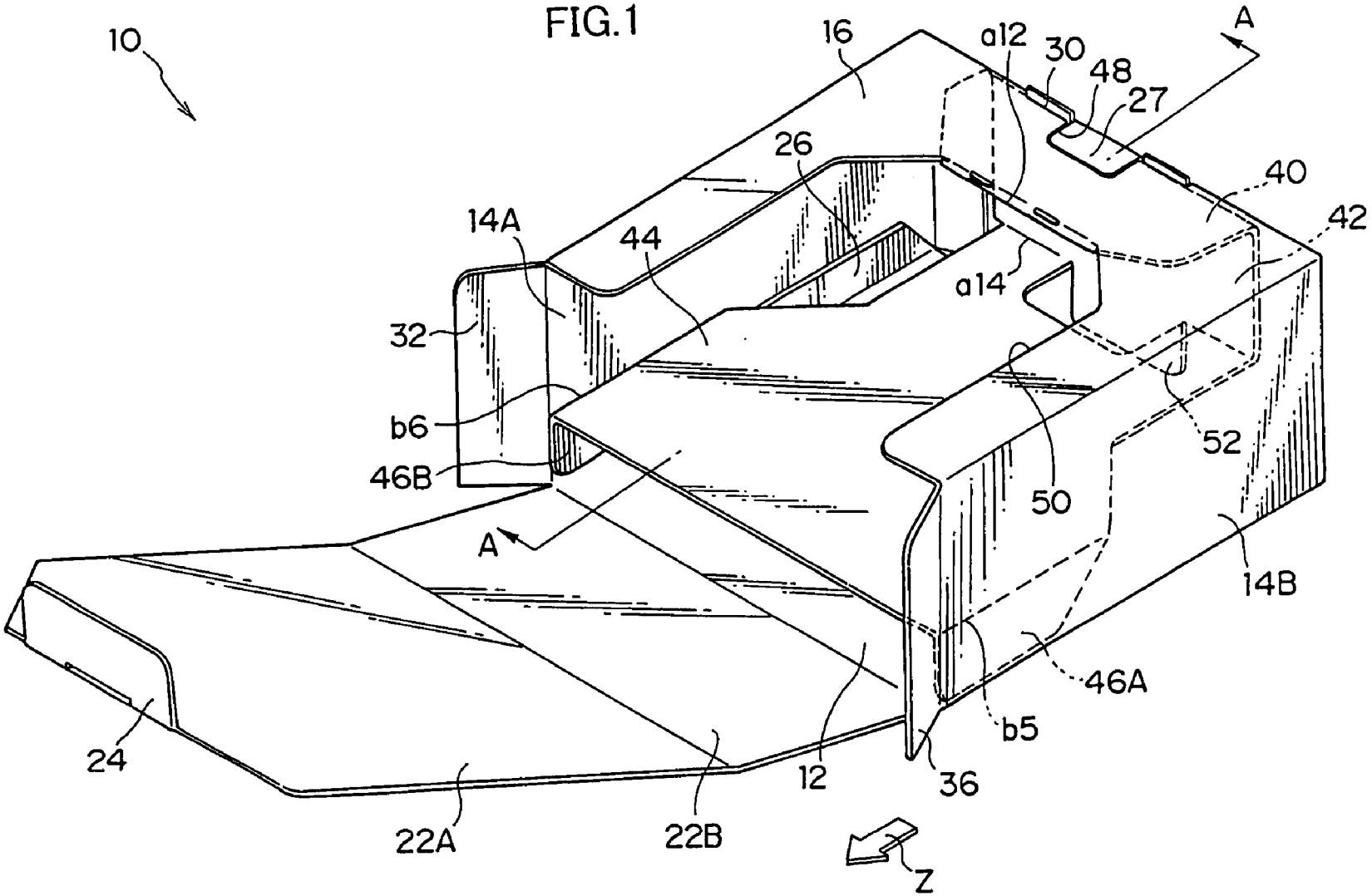
FIG. 1 is a perspective view showing a carton according to a first embodiment when a partition plate is accommodated.
Figure 2:
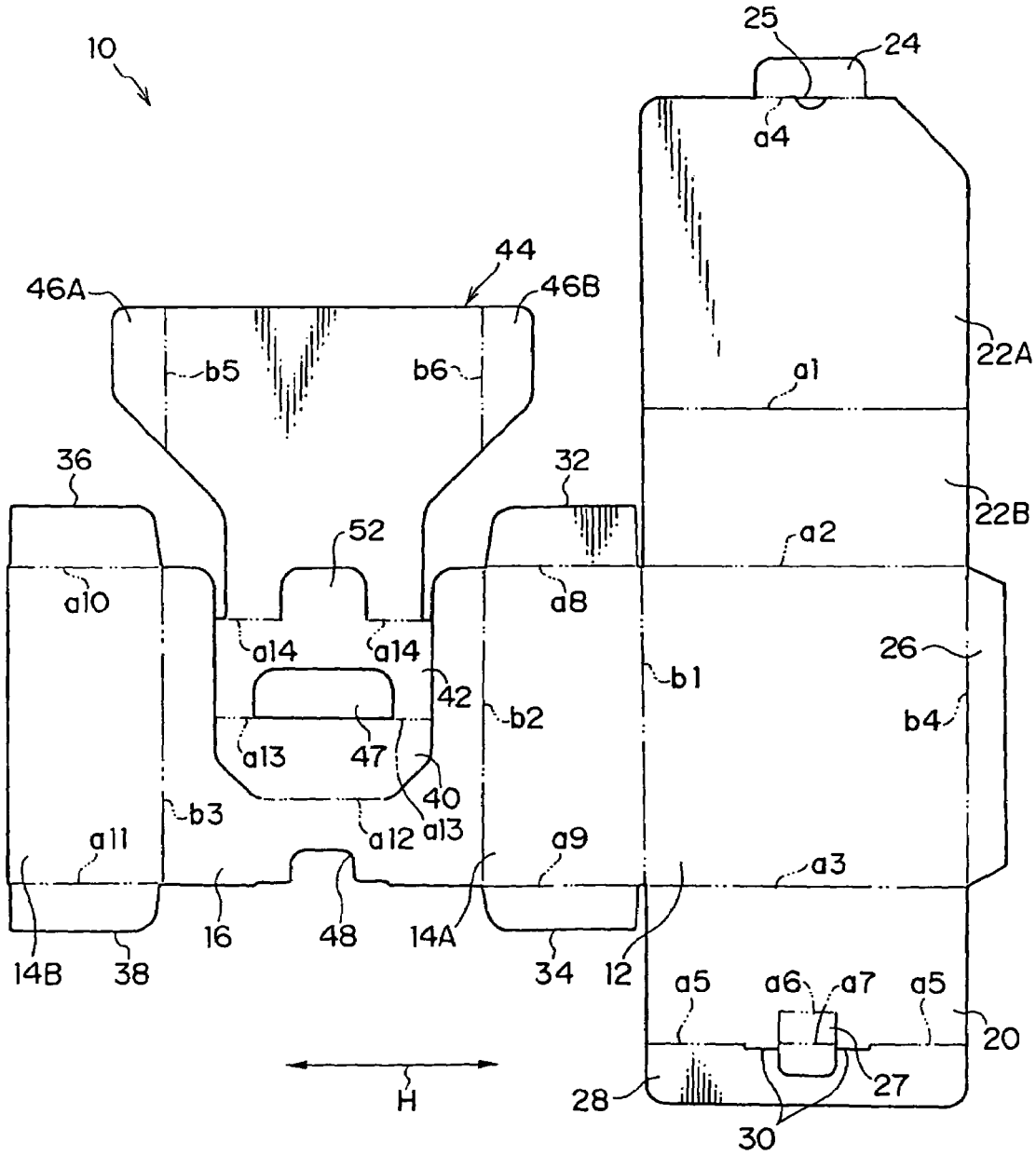
FIG. 2 is a development of the carton according to the first embodiment.

FIG. 1 is a perspective view of a carton 10 of this embodiment, and FIG. 2 is a development of the carton 10 showing a printed surface thereof. It should be noted that solid lines in FIG. 2 refer to so-called cutoff lines, and components which are adjacent to each other via the solid lines are separated from each other. Chain double-dashed lines in FIG. 2 refer to so-called bend lines, and components which are adjacent to each other via the bend lines are connected. The printed surface refers to a surface of the carton 10 which faces outside when the carton 10 is assembled, on which printing for effectively displaying the product is provided.

As shown in FIG. 2, the carton 10 comprises a cover plate 20, and parts forming a body of the carton including a bottom plate 12, side plates 14A and 14B, an upper plate 16, and cover plates 22A and 22B. All of these components and those described later are formed integrally from a single plate.

As shown in FIG. 2, the bottom plate 12, the side plate 14A, the upper plate 16 and the side plate 14B are connected in this order in direction H. The side plate 14A and the bottom plate 12 are connected via a bend line b1, the upper plate 16 and the side plate 14A are connected via a bend line b2, and the side plate 14B and the upper plate 16 are connected via a bend line b3. As shown in FIG. 1, the carton 10 is bent at the bend lines b1 to b3 such that a back surface thereof faces inside and adjacent plates are perpendicular to each other. A portion to be glued 26 is connected to the bottom plate 12 via a bend line b4 at a side of the bottom plate 12 opposite to the bend line b1, and the carton 10 is bent at the bend line b4 such that the back surface faces inside and the portion to be glued 26 is perpendicular to the bottom plate 12. The bend line b4 is substantially matched with an edge of the side plate 14B at a side opposite to the bend line b3, and the printed surface of the portion to be glued 26 is glued on the back surface of the side plate 14B with an adhesive.

Figure 3:
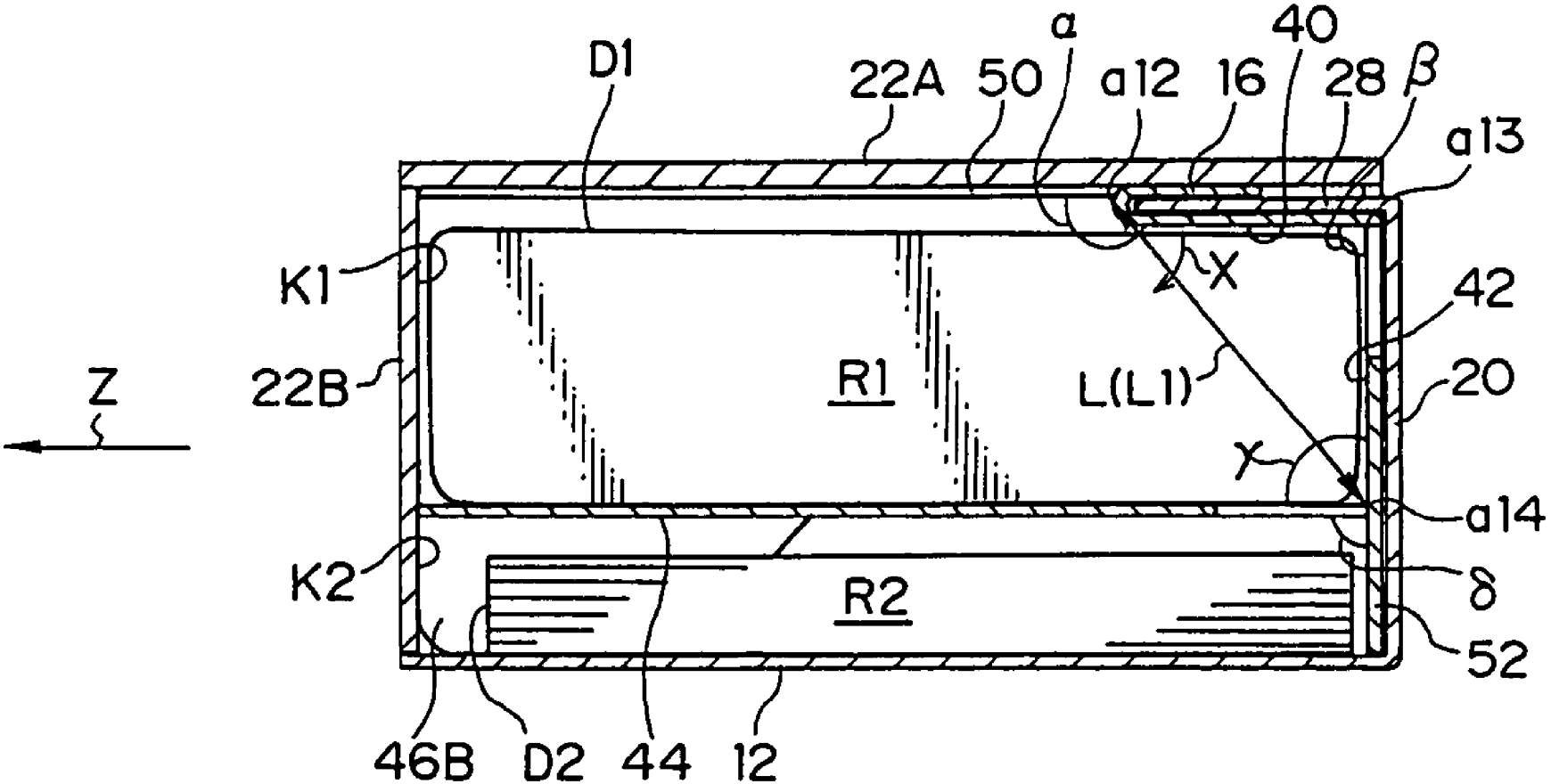
FIG. 3 is a sectional view taken along line A-A in FIG. 1, showing the carton in which objects are packaged.

The cover plate 22A, the cover plate 22B, the bottom plate 12 and the cover plate 20 are connected in this order in a direction perpendicular to direction H. The cover plate 22A and the cover plate 22B are connected via a bend line a1, the cover plate 22B and the bottom plate 12 are connected via a bend line a2, and the bottom plate 12 and the cover plate 20 are connected via a bend line a3. A lock plate 24 is connected to the cover plate 22A via a bend line a4 at a central portion of an edge of the cover plate 22A opposite to the bend line a1. A hole 25, in which a lock plate 27 (described later) and a finger of a user can be inserted, is formed at a central portion of the bend line a4. A lock plate 28 is connected to the cover plate 20 via a bend line a5 at an edge of the cover plate 20 opposite to the bend line a3. A hole 30, in which the lock plate 24 can be inserted, is formed at a central portion of the bend line a5. The lock plate 27 is connected to the cover plate 20 via a bend line a6 at a central portion of a side of the cover plate 20 adjacent to the lock plate 28. A bend line a7 parallel with the bend line a6 is formed at the center of the lock plate 27. The carton 10 can be bent at the bend lines a1 to a5 and a7 such that the back surface, which is opposite to the printed surface, faces inside. As shown in FIG. 3, when the cover plates 22A and 22B and the cover plate 20 are closed, they are bent such that the adjacent plates are perpendicular to each other. At the bend line a6, the carton 10 can be bent such that the printed surface faces inside. When the cover plate 20 is closed, the lock plate 27 is once bent outward from the cover plate 20, so that the lock plate 27 can be easily inserted into the hole 25.

As shown in FIG. 2, flaps 32 and 34 are respectively connected to opposite edges of the side plate 14A via bend lines a8 and a9, and flaps 36 and 38 are respectively connected via bend lines a10 and a11 to opposite edges of the side plate 14B perpendicular to the bend line b3. At the bend lines a8 to all, the carton 10 can be bent such that the back surface faces inside. When the cover plates 22A and 22B and the cover plate 20 are closed, the flaps 32, 34, 36 and 38 are bent so as to be perpendicular to the side plate 14A or 14B, and are accommodated in the carton 10.

As shown in FIG. 2, a notch 48 is formed at a central portion of an edge of the upper plate 16, which edge is adjacent to the cover plate 20 when the carton is assembled. Further, as shown in FIG. 1, a window 50 is formed in the upper plate 16 such that an area of the upper plate 16 from a central portion to a cover plate 22B side thereof is open.

As shown in FIG. 2, a partition plate 44, a second connection plate 42 and a first connection plate 40 serving as connection plates are connected in this order in the direction perpendicular to direction H. The first connection plate 40 is connected to the upper plate 16 via a bend line a12. The second connection plate 42 is connected to the first connection plate 40 via a bend line a13, and to the partition plate 44 via a bend line a14. A hole 47 is formed in the second connection plate 42 at a central portion of a bend line a13 side thereof.

A support plate 46A is connected to one edge of the partition plate 44, which is perpendicular to direction H, via a bend line b5, and a support plate 46B is connected to another edge of the partition plate 44 via a bend line b6. As shown in FIG. 1, the carton 10 is bent at the bend lines b5 and b6 such that the back surface faces inside and the support plates 46A and 46B are respectively perpendicular to the partition plate 44. An edge of the support plate 46A parallel to the bend line b5 and an edge of the support plate 46B parallel to the bend line b6 abut on an inner surface of the bottom plate 12.

Figure 4:
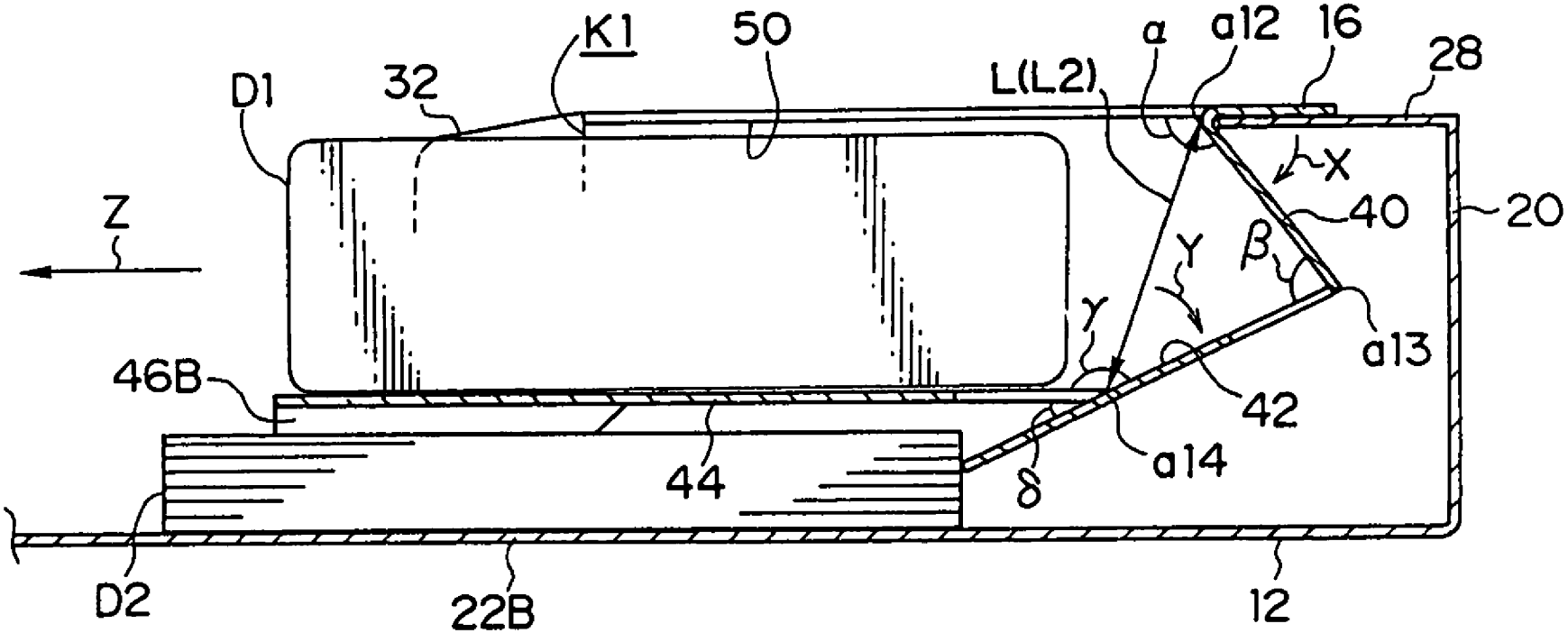
FIG. 4 is a sectional view taken along line B-B in FIG. 5, showing the carton in which objects are packaged.
Figure 6:
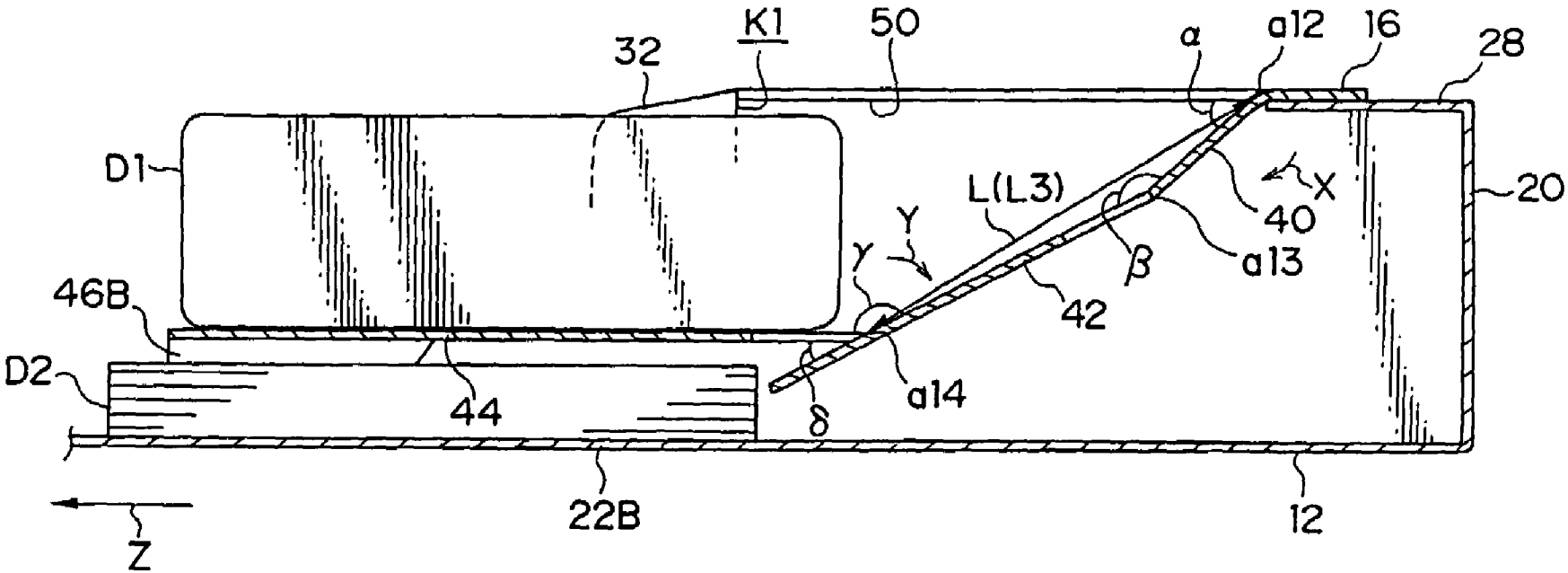
FIG. 6 is a sectional view taken along line C-C in FIG. 7, showing the carton in which objects are packaged.

As shown in FIGS. 3, 4 and 6, the carton 10 is bent at the bend line a12 such that the back surface faces inside and an angle between the first connection plate 40 and the upper plate 16 is an angle $\alpha$. The first connection plate 40 rotates around the bend line a12, and the angle $\alpha$ varies within a range of $0° < \alpha \leqq 180°$. At the bend line a13, the carton 10 is bent such that the printed surface faces inside and an angle between the second connection plate 42 and the first connection plate 40 is an angle $\beta$. The angle $\beta$ varies within a range of $0° \leqq \beta \leqq 180°$ along with rotation of the first connection plate 40 and rotation and movement of the second connection plate 42. At the bend line a14, the carton 10 is bent such that the printed surface faces inside and an angle between the partition plate 44 and the second connection plate 42 is an angle $\gamma$. The angle $\gamma$ varies within a range of $0° \leqq \gamma \leqq 180°$ along with movement and rotation of the second connection plate 42 and movement of the partition plate 44.

A distance L between the bend line a12 and the bend line a14 is L=L1 when the partition plate 44 is accommodated (see FIG. 3), L=L2 when the partition plate 44 is pulled out by a small amount (see FIG. 4) and L=L3 when the partition plate 44 is almost completely pulled out (see FIG. 6).

An object moving plate 52 is connected to the second connection plate 42 at a central portion of a bend line a14 side thereof. A plane of the object moving plate 52 and a plane of the second connection plate 42 are always coplanar regardless of changes in angles $\alpha$, $\beta$ and $\gamma$. An angle between the object moving plate 52 and the partition plate 44 is an angle $\delta$. When the partition plate 44 is accommodated, an edge of the object moving plate 52 along direction H (see FIG. 2) abuts on the back surface of the bottom plate 12.

In the carton 10 having the above-described structure, when the partition plate 44 is accommodated in the carton 10 and the cover plate 20 and the cover plates 22A and 22B are closed, a space surrounded by the bottom plate 12, the upper plate 16, the side plates 14A and 14B, the cover plate 20 and the cover plates 22A and 22B is partitioned by the partition plate 44 into a first accommodation room R1 and a second accommodation room R2, as shown in FIG. 3.

An opening K1 is formed at a cover plate 22B side of the first accommodation room R1, and an object to be packaged, such as a digital camera, placed on a tray (hereinafter referred to as an "object D1" including the tray) can be put in or taken out through the opening K1. An opening K2 is formed at a cover plate 22B side of the second accommodation room R2, and an object D2, such as an manual, can be put in or taken out through the opening K2.

Next, operation of this embodiment is described.

As shown in FIG. 3, the partition plate 44 is accommodated when the angle $\alpha$ is 180°, the angle $\beta$ is 90° and the angle $\gamma$ is 90°. At this time, the distance L between the bend line a12 and the bend line a14 is L1. In the accommodation room R1 formed in this state, the object D1 is accommodated through the opening K1 and is placed on the partition plate 44. Also, the object D2 is accommodated in the accommodation room R2 through the opening K2. Then, the carton 10 is bent at the bend line a3 such that the back surface faces inside and the cover plate 20 and the bottom plate 12 are perpendicular to each other. Then, the lock plate 28 is inserted under the upper plate 16 to close the cover plate 20. Subsequently, the carton 10 is bent at the bend lines a1 and a2 such that the back surface faces inside and the cover plates 22A and 22B as well as adjacent plates are perpendicular to each other. Then, the lock plate 24 is inserted into the hole 30 to close the cover plates 22A and 22B. The lock plate 27 is bent at the bend line a7 at an angle of 90° such that the back surface faces inside, and a portion of the lock plate 27 from the tip thereof to the bend line a7 is inserted in the hole 25 to fix the cover plates 22A and 22B. Thus, packaging of the objects D1 and D2 is completed.

When the objects D1 and D2 are taken out from the package, the lock plate 27 is pulled out from the hole 25, the lock plate 24 is pulled out from the hole 30, and the cover plates 22A and 22B are opened. At this time, since most of the surface seen by a user is the printed surface, this allows the object to be effectively displayed when the cover plates are opened.

Figure 5:
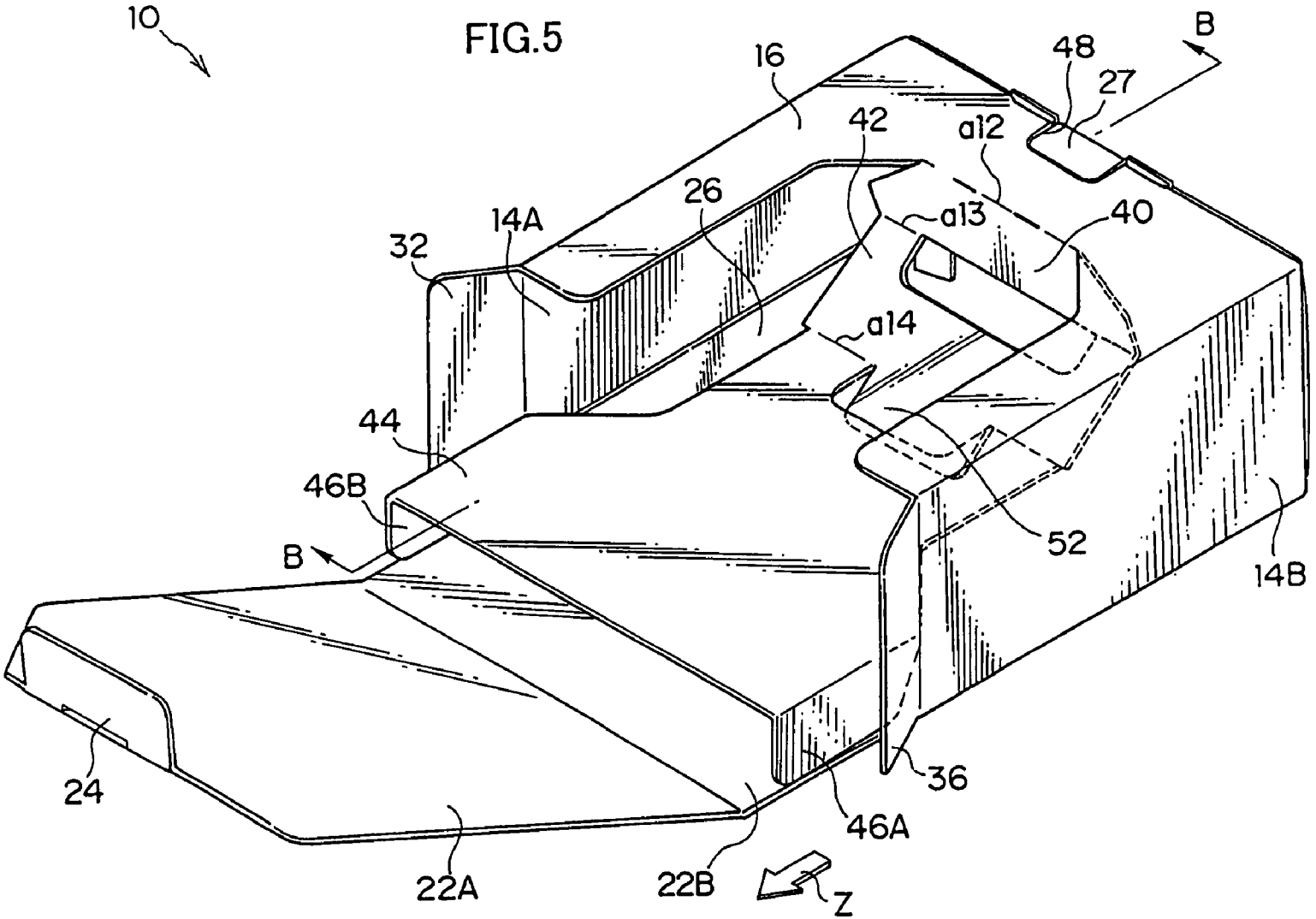
FIG. 5 is a perspective view showing the carton according to the first embodiment when the partition plate is pulled out by a small amount.

As shown in FIG. 4, as the partition plate 44 is pulled in direction Z along the plane of the partition plate 44 outward from the openings K1 and K2, the first connection plate 40 rotates around the bend line a12 in direction X, decreasing the angle $\alpha$. A portion of the second connection plate 42 along the bend line a14 moves in the same direction as the movement of the partition plate 44, and the second connection plate 42 rotates in direction Y, increasing the angle $\gamma$. A portion of the object moving plate 52 along the bend line a14 moves in the same direction as the movement of the partition plate 44, i.e., in direction Z, and the object moving plate 52 rotates in direction Y, decreasing the angle $\delta$. In this manner, as also shown in FIG. 5, the partition plate 44 is pulled out in direction Z, and the object D1 placed on the partition plate 44 is also pulled out together with the partition plate 44. As the object moving plate 52 moves in direction Z, the object D2 is pushed by the object moving plate 52 and moves in direction Z. At this time, as shown in FIG. 4, the distance L between the bend line a12 and the bend line a14 is L2 (L2<L1), which is shorter than that when the partition plate 44 is accommodated as described above.

Figure 7:
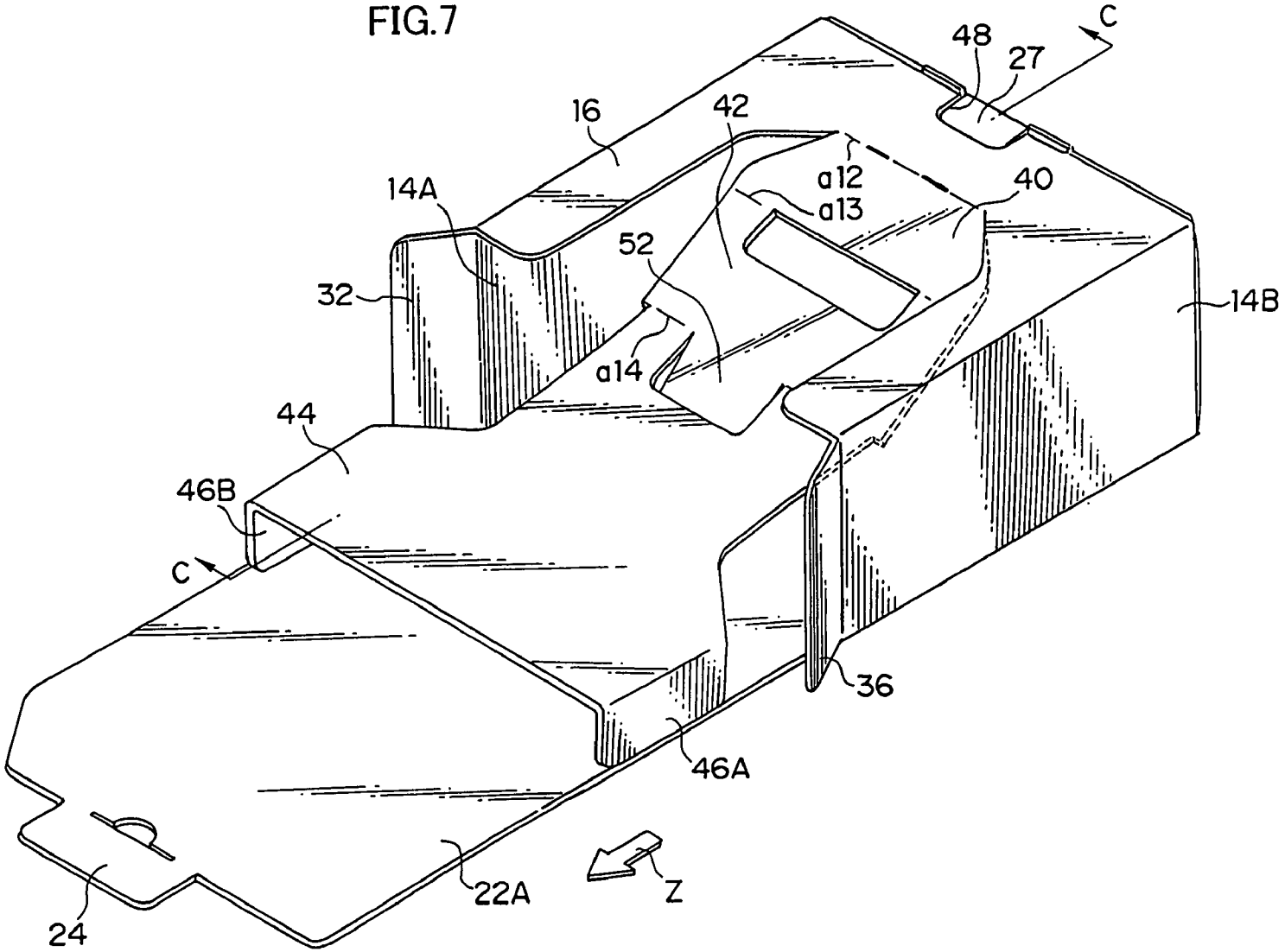
FIG. 7 is a perspective view showing the carton according to the first embodiment when the partition plate is completely pulled out.

As shown in FIG. 6, when the partition plate 44 is further pulled in direction Z, the first connection plate 40 rotates around the bend line a12 in direction X, further decreasing the angle $\alpha$. The portion of the second connection plate 42 along the bend line a14 moves further in the same direction as the movement of the partition plate 44, and the second connection plate 42 rotates in direction Y, further increasing the angle $\gamma$. Along with this, the angle $\beta$ between the first connection plate 40 and the second connection plate 42 increases. The portion of the object moving plate 52 along the bend line a14 moves further in direction Z, and the object moving plate 52 rotates in direction Y, further decreasing the angle $\delta$. In this manner, as also shown in FIG. 7, the partition plate 44 is pulled out in direction Z, and the object D1 placed on the partition plate 44 is also pulled out together with the partition plate 44. As the object moving plate 52 moves in direction Z, the object D2 is pushed by the object moving plate 52 and moves in direction Z. At this time, as shown in FIG. 6, the distance L between the bend line a12 and the bend line a14 is L3 (L2<L1<L3), which is longer than both of those when the partition plate 44 is accommodated and when the partition plate 44 is pulled out by a small amount.

In the carton 10 according to this embodiment, the first connection plate 40 connected to the upper plate 16, and the second connection plate 42 connected to the partition plate 44 are joined together to allow articulated movement thereof, and along with their movement, the angles $\alpha$, $\beta$ and $\gamma$ change. This allows the distance between the bend line a12 and the bend line a14 to change, thereby permitting the partition plate 44 to move in direction Z along the plane of the plate. Therefore, when the object D1 is packaged being placed on the partition plate 44, the object D1 can be easily taken out from the package by moving the object D1 and the partition plate 44 outward from the opening, i.e., in direction Z, thereby increasing convenience. Since the partition plate 44, the first connection plate 40, the second connection plate 42, the bottom plate 12, the side plates 14A and 14B and the upper plate 16 are integrally formed, the carton 10 can be easily produced, and the number of parts is smaller than that when each part is separately formed. Therefore, production costs can be reduced.

Figure 8:
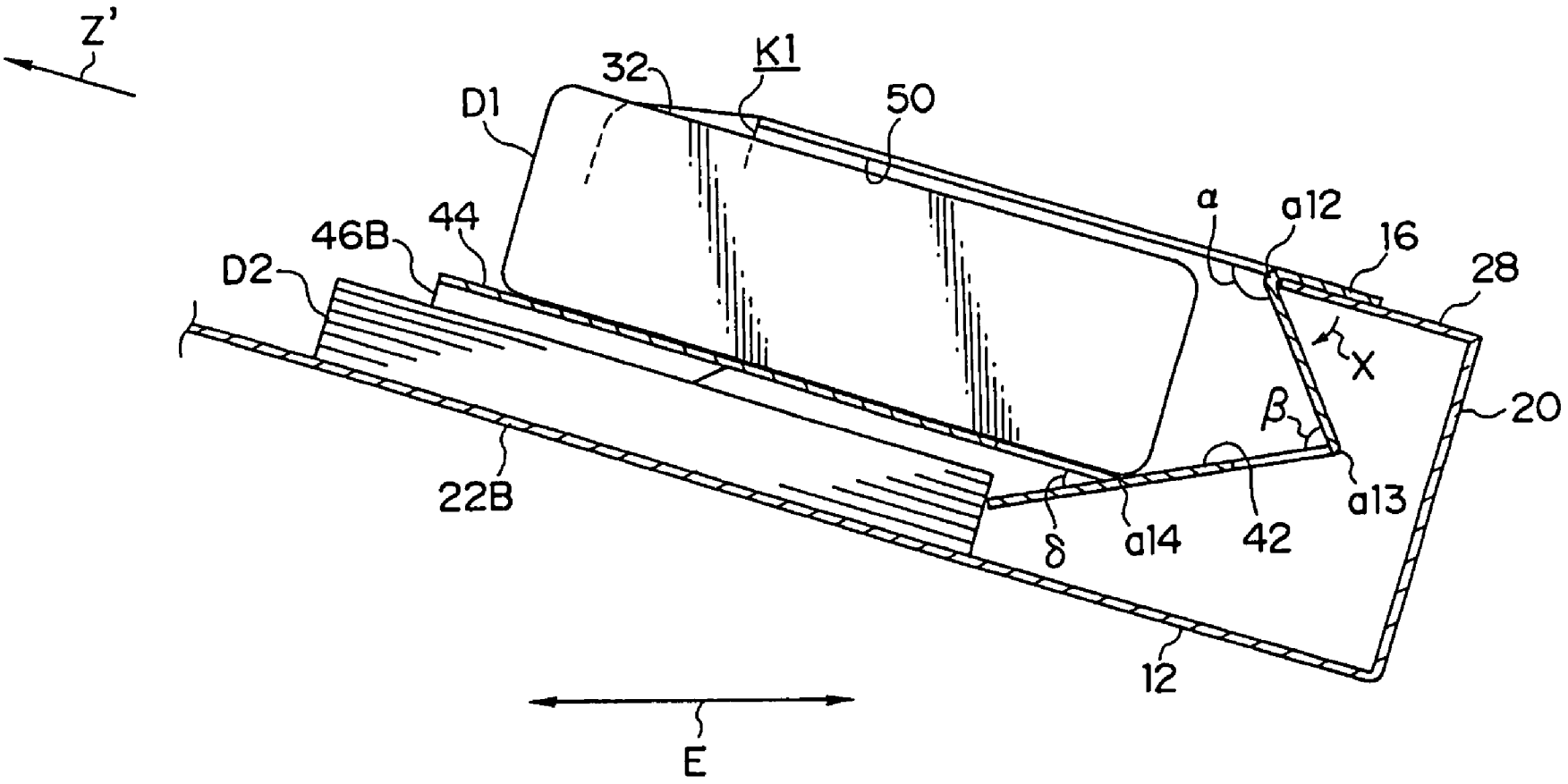
FIG. 8 is a sectional view showing the carton according to the first embodiment when it is inclined.

In the above-described example, the object D1 is placed on the horizontal partition plate 44 and is pulled out together with the partition plate 44. However, as shown in FIG. 8, for example, when the carton 10 is inclined with respect to horizontal direction E and an opening K1 side of the plane of the partition plate 44 is higher than a cover plate 20 side thereof, the object D1 is pushed by the second connection plate 42 (see a portion around the bend line 14) and moved in direction Z'. In this case, the second connection plate 42 also serves as an object moving member.

Figure 9:
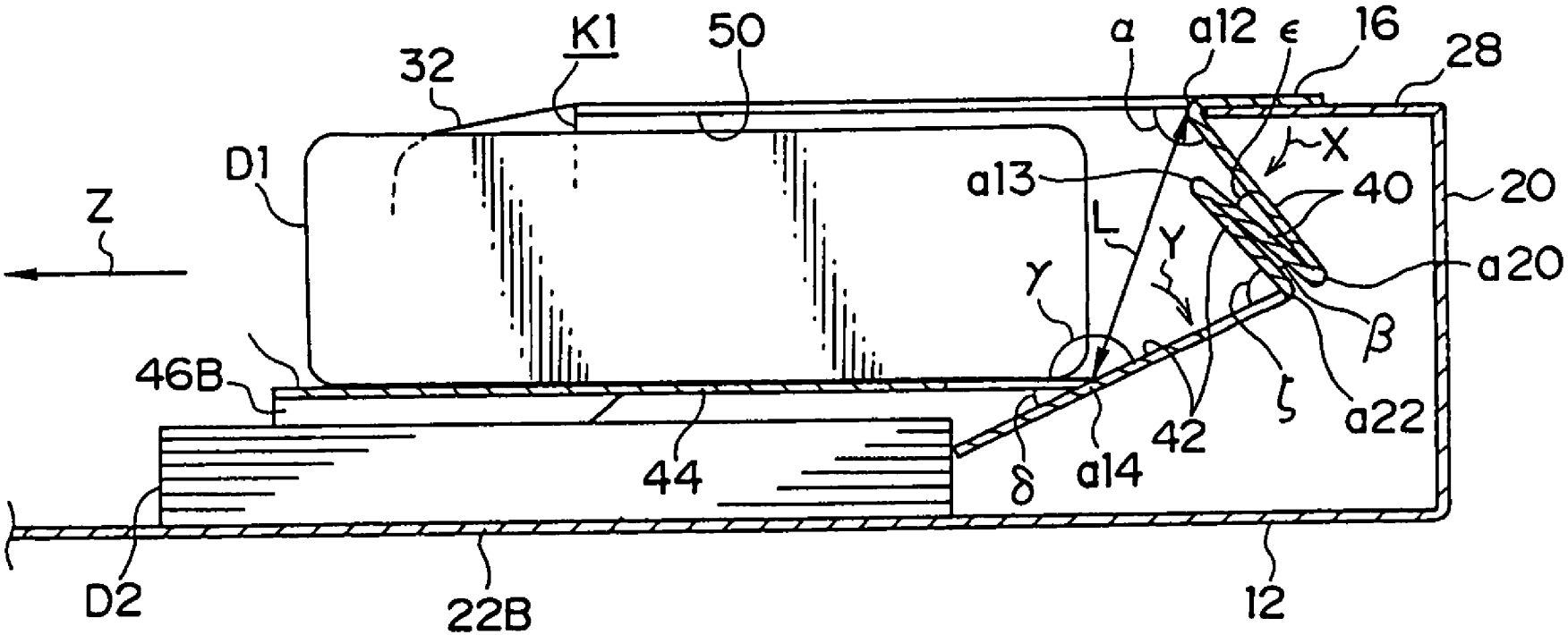
FIG. 9 is a perspective view showing a modification of the carton according to the first embodiment.

It should be noted that, although the distance L between the bend line a12 and the bend line a14 is made changeable by making the angles α, β and γ changeable, the distance L may be changed in a different manner. For example, as shown in FIG. 9, the first connection plate 40 is extended in a direction perpendicular to the bend line a12, and a bend line a20 parallel to the bend line a12 is formed at a central portion of the first connection plate 40. Further, the second connection plate 42 is extended in a direction perpendicular to the bend line a14, and a bend line a22 parallel to the bend line a14 is formed at a central portion of the second connection plate 42. The distance between the bend line a12 and the bend line a14 can be changed when an angle ϵ, which is formed when the carton 10 is bent at the bend line a20 such that the printed surface faces inside, and an angle ζ, which is formed when the carton 10 is bent at the bend line a22 such that the back surface faces inside, are changeable.

Although the carton of this embodiment is formed as shown by the development of FIG. 2, the carton is not necessarily formed in this manner. For example, the side plate 14B and the upper plate 16 may be connected to the bottom plate 12 via the bend line b4, and the portion to be glued may be connected to the side plate 14A via the bend line b2. However, the carton can be efficiently formed according to the development of FIG. 2, leading to cost reduction.

The cover plates 22A and 22B are not essential, and the objects may be packaged with the openings K1 and K2 remaining open. However, by covering the openings K1 and K2 with the cover plates 22A and 22B as in this embodiment, the object is not exposed to the outside and thus can be protected. The cover plate 20 need not be a cover which can be opened or closed, and may be fixed in a position perpendicular to the bottom plate 12 to serve as a part of the body of the carton.

The window 50 is not essential, and the upper plate 16 may be formed without the window 50. However, by providing the window 50 as in this embodiment, the object is easily seen from outside when the cover plates 22A and 22B are opened, allowing effective display of the object.

The object moving plate 52 is not essential, however, provision of the object moving plate 52 allows the object accommodated in the accommodation room R2 to be pulled out together with the partition plate 44, thereby increasing convenience. Further, since the object moving plate 52 is connected integrally to the second connection plate 42, the object moving plate 52 can be formed integrally with other components. Thus, the carton 10 having the above-described effect can be easily produced and the number of parts can be reduced.

In addition, the object moving plate 52 greatly contributes to keeping the partition plate 44 in an accommodated state at a fixed height.

It should be noted that, unlike in this embodiment in which the object moving plate 52 pushes out the object, the object moving plate 52 may be disposed at an opening K2 side of the partition plate 44, and may engage with the object to fix the object to the partition plate 44. Further, the object moving plate 52 may be adapted to pull out the object by partially engaging with the object.

Second Embodiment

A second embodiment will now be described. Components that are similar to those in the first embodiment are identified with the same reference numerals, and are not described in detail.

Figure 10:
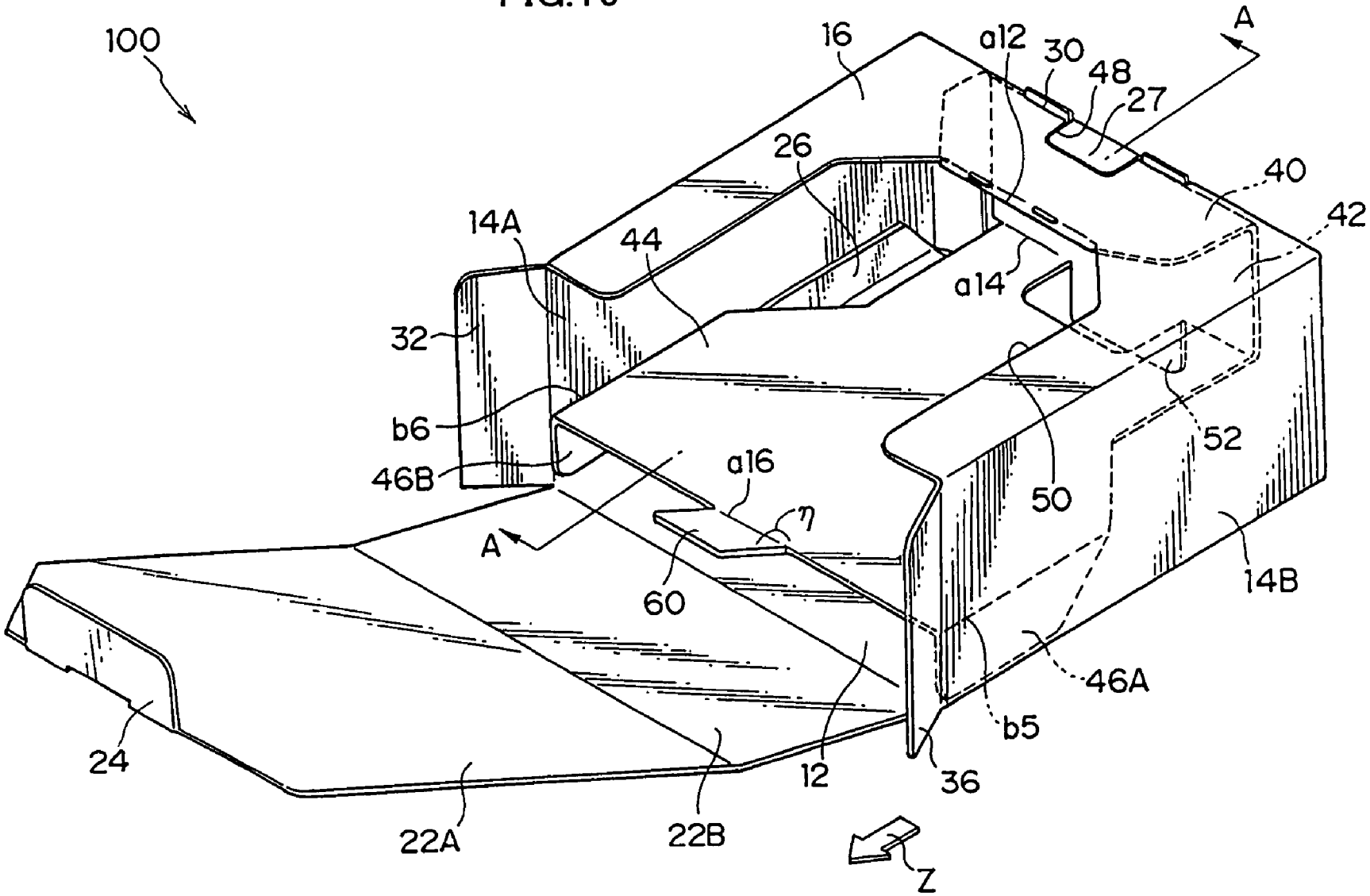
FIG. 10 is a perspective view showing a carton according to a second embodiment when a partition plate is accommodated.
Figure 11:
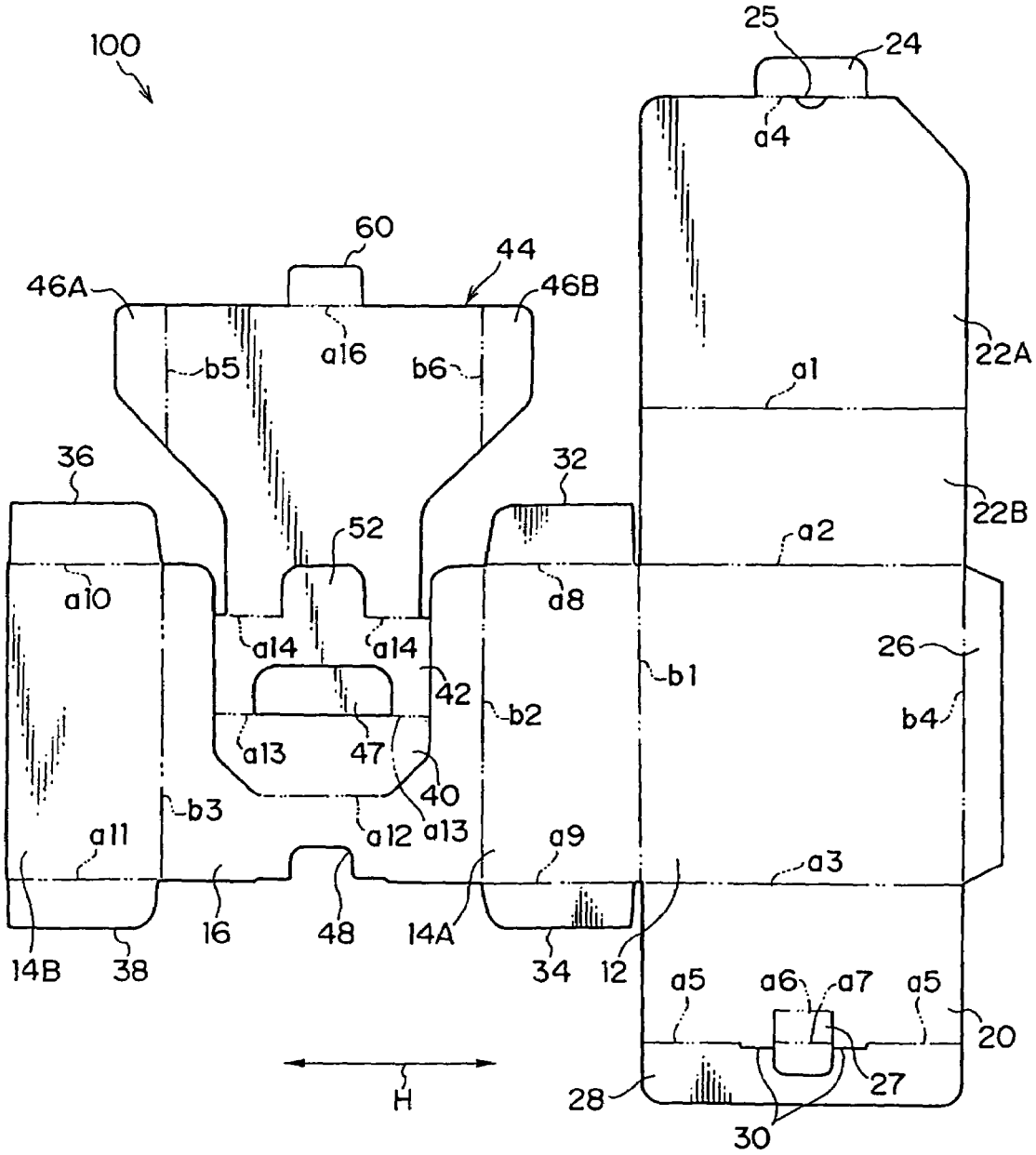
FIG. 11 is a development of the carton according to the second embodiment.

FIG. 10 is a perspective view of a carton 100 of this embodiment, and FIG. 11 is a development of the carton 100 showing a printed surface thereof.

As shown in FIG. 11, a handle 60 has a rectangular plate shape and is connected to a substantially central portion of an edge of the partition plate 44 along direction H via a bend line a16. As shown in FIG. 10, the carton 100 is bent at the bend line a16 such that a printed surface thereof faces inside and an angle between the handle 60 and the partition plate 44 is an angle η. In a normal state (when no force is applied to the handle 60), the angle η is greater than 90°. Other parts are the same as in the first embodiment, and therefore are not described in detail.

Next, operation of this embodiment is described.

Figure 12:
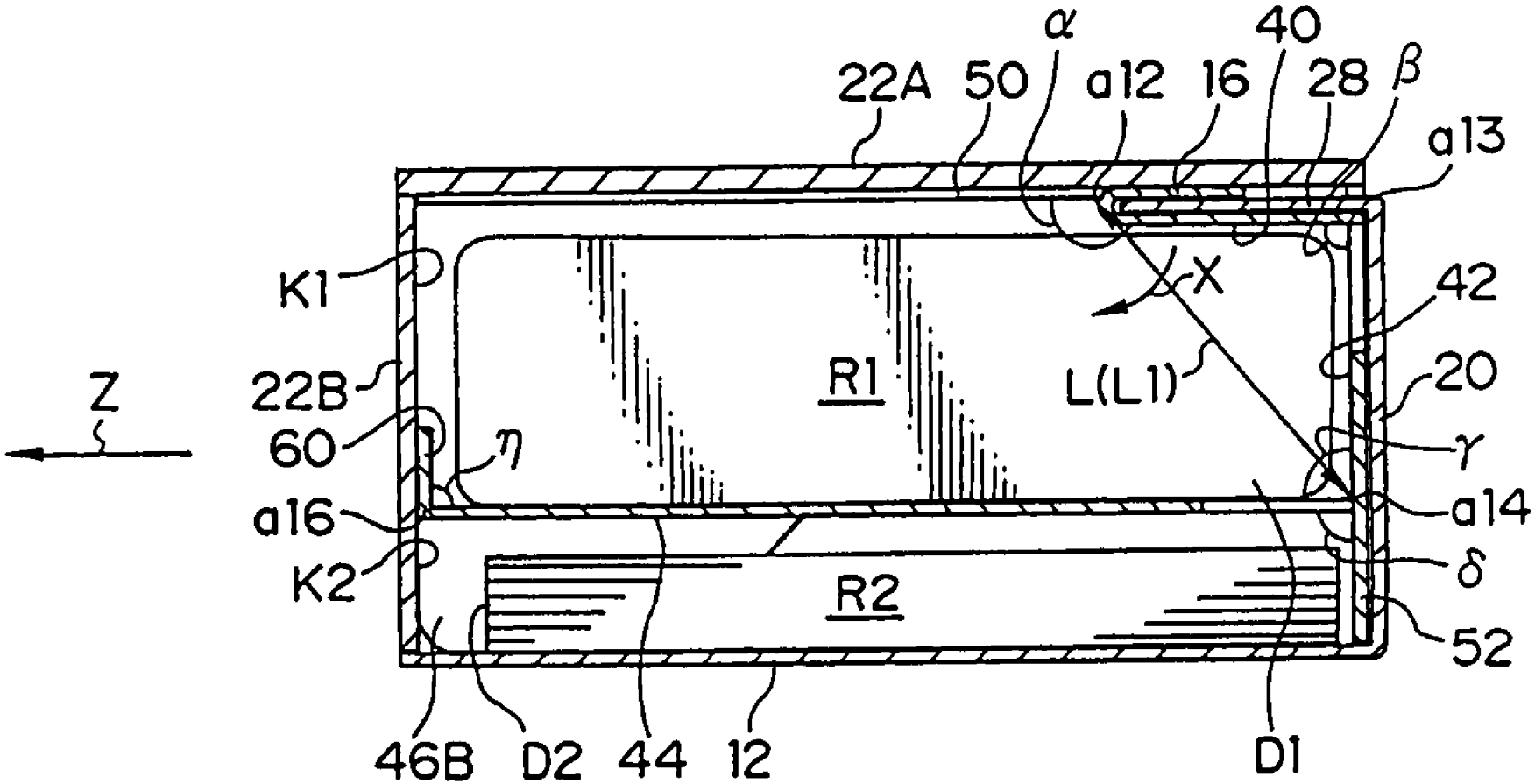
FIG. 12 is a sectional view taken along line A-A in FIG. 10, showing the carton in which objects are packaged.

As shown in FIG. 12, the partition plate 44 is accommodated when the angle α is 180°, the angle β is 90°, and the angle γ is 90°. At this time, the distance L between the bend line a12 and the bend line a14 is L1. In the accommodation room R1 formed in this state, the object D1 is accommodated through the opening K1 and is placed on the partition plate 44. Also, the object D2 is accommodated in the accommodation room R2 through the opening K2. At the bend line a16, the carton 100 is bent such that the printed surface faces inside and the angle η is 90°, and at the bend line a3, the carton 100 is bent such that the back surface faces inside and the cover plate 20 and the bottom plate 12 are perpendicular to each other. Then, the lock plate 28 is inserted under the upper plate 16 to close the cover plate 20. It should be noted that the carton 100 could be bent at the bend line a16 such that the printed surface faces outside. At the bend lines a1 and a2, the carton 100 is bent such that the back surface faces inside and the cover plates 22B and 22B as well as adjacent plates are perpendicular to each other. Then, the lock plate 24 is inserted into the hole 30 to close the cover plates 22A and 22B. Subsequently, the lock plate 27 is bent at the bend line a7 at an angle of 90° such that the back surface faces inside, and the portion of the lock plate 27 from the tip thereof to the bend line a7 is inserted in the hole 25 to fix the cover plates 22A and 22B. Thus, packaging of the objects D1 and D2 is completed. At this time, the handle 60 is pushed by the cover plate 22B from the outside of the opening K1 and the angle η is kept at 90, and the handle 60 is urged in direction Z by a restoring force at the bend line a16.

When the objects D1 and D2 are taken out from the package, the lock plate 27 is pulled out from the hole 25, the lock plate 24 is pulled out from the hole 30, and the cover plates 22A and 22B are opened. At this time, since most of the surface seen from a user is the printed surface, it allows the object to be effectively displayed when the cover plates are opened.

Figure 13:
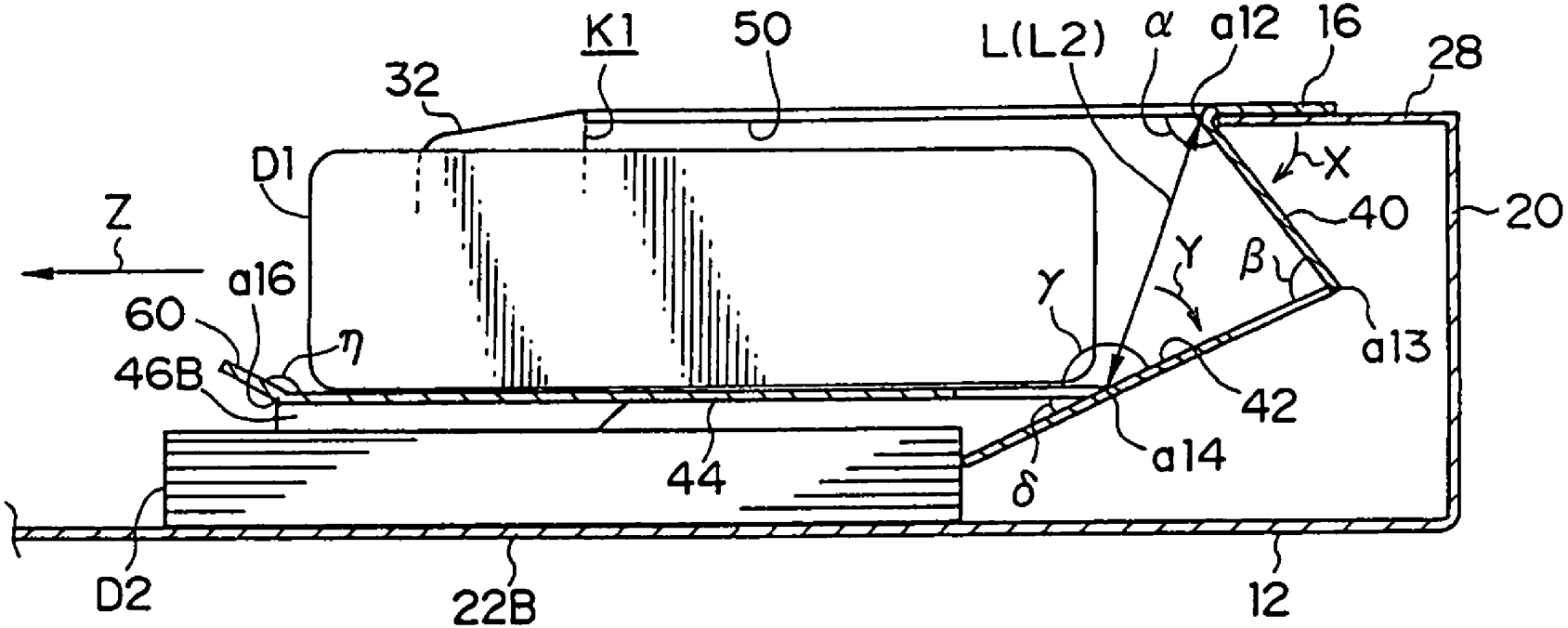
FIG. 13 is a sectional view taken along line B-B in FIG. 14, showing the carton in which objects are packaged.
Figure 14:
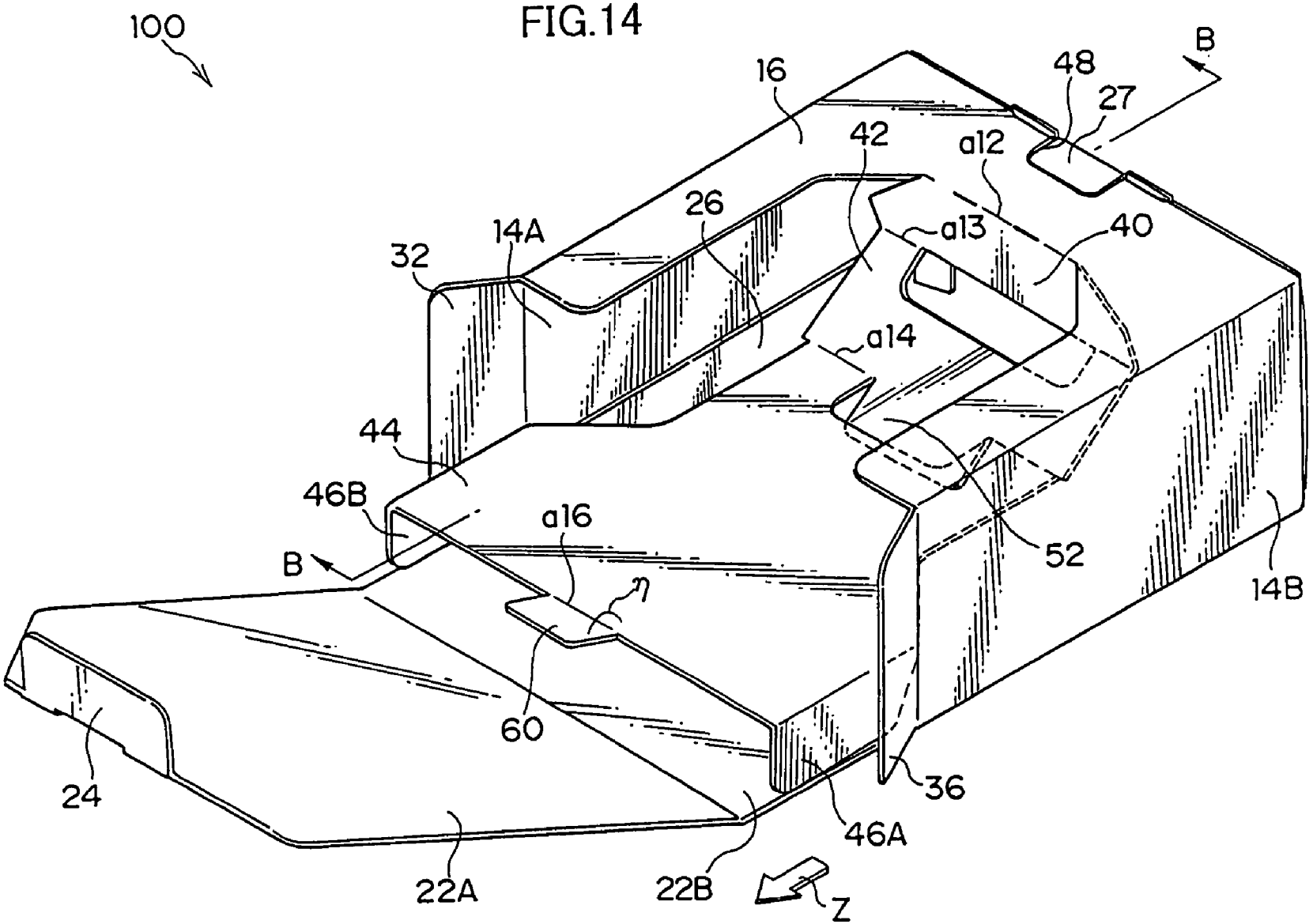
FIG. 14 is a perspective view showing the carton according to the second embodiment when the partition plate is pulled out by a small amount.

When the cover plates 22A and 22B are opened, the handle 60 rotates in a direction, in which the angle η is increased, due to the restoring force at the bend line a16, and projects outward from the opening K1. When a user pulls the handle 60 to apply a force in direction Z along the plate plane outward from the openings K1 and K2 to the handle 60, a force in the same direction is applied to the partition plate 44. Then, as shown in FIG. 13, the first connection plate 40 rotates around the bend line a12 in direction X, decreasing the angle α. The portion of the second connection plate 42 along the bend line a14 moves in direction Z, and the second connection plate 42 rotates in direction Y, increasing the angle γ. The portion of the object moving plate 52 along the bend line a14 moves in direction Z, and the object moving plate 52 rotates in direction Y, decreasing the angle δ. In this manner, as also shown in FIG. 14, the partition plate 44 is pulled out in direction Z, and the object D1 placed on the partition plate 44 is also pulled out together with the partition plate 44. As the object moving plate 52 moves in direction Z, the object D2 is pushed by the object moving plate 52 and moves in direction Z. At this time, as shown in FIG. 13, the distance L between the bend line a12 and the bend line a14 is L2 (L2<L1), which is shorter than that when the partition plate 44 is accommodated as described above.

Figure 15:
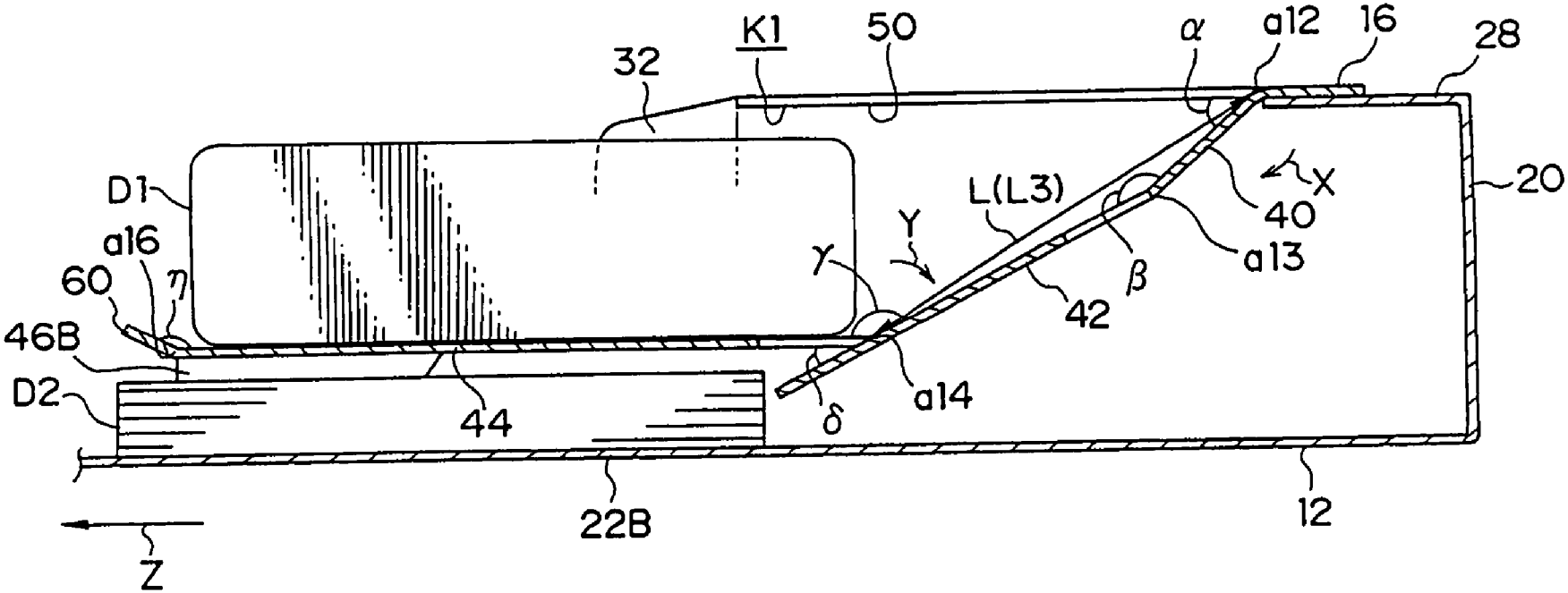
FIG. 15 is a sectional view taken along line C-C in FIG. 16, showing the carton in which objects are packaged.
Figure 16:
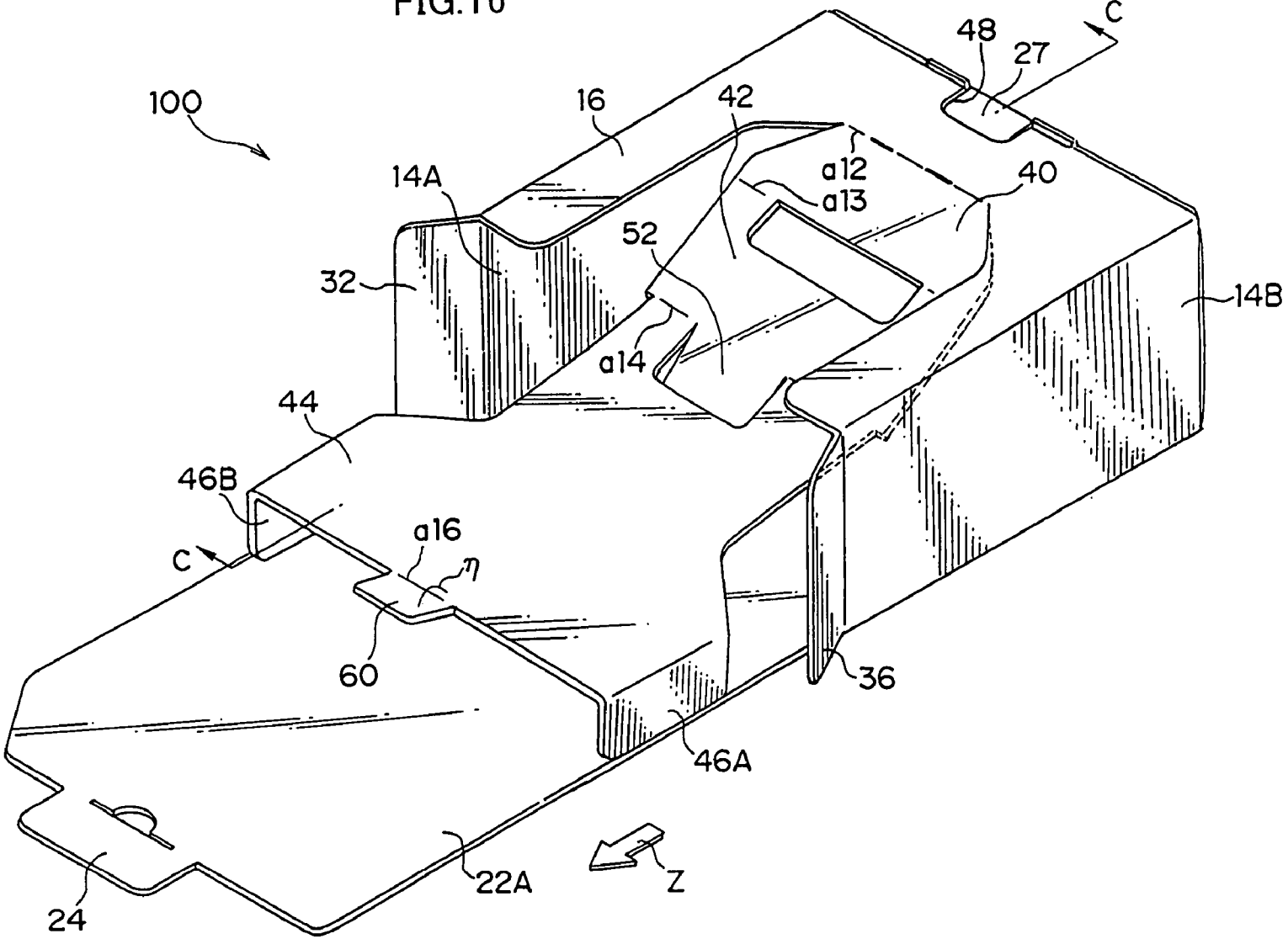
FIG. 16 is a perspective view showing the carton according to the second embodiment when the partition plate is completely pulled out.

As shown in FIG. 15, when the force in direction Z is further applied to the handle 60, the first connection plate 40 rotates around the bend line a12 in direction X, further decreasing the angle α. The portion of the second connection plate 42 along the bend line a14 moves further in direction Z, and the second connection plate 42 rotates in direction Y, further increasing the angle γ. Along with this, the angle β between the first connection plate 40 and the second connection plate 42 increases. The portion of the object moving plate 52 along the bend line a14 moves further in direction Z, and the object moving plate 52 rotates in direction Y, further decreasing the angle δ. In this manner, as also shown in FIG. 16, the partition plate 44 is pulled out in direction Z, and the object D1 placed on the partition plate 44 is also pulled out together with the partition plate 44. As the object moving plate 52 moves in direction Z, the object D2 is pushed by the object moving plate 52 and moves in direction Z. At this time, as shown in FIG. 15, the distance L between the bend line a12 and the bend line a14 is L3 (L2<L1<L3), which is longer than both of those when the partition plate 44 is accommodated and when the partition plate 44 is pulled out by a small amount.

In the carton 100 according to this embodiment, the handle 60 is provided, and a user can grasp the handle 60 to apply a force in direction Z to the handle 60. In this manner, the user operator can move the partition plate along the plate plane outward from the openings easier than in the case in which the handle 60 is not provided. When the object D1 is packaged with being placed on the partition plate 44, the object D1 can be easily taken out from the package by moving the object D1 and the partition plate 44 outward from the opening, i.e., in direction Z, thereby increasing convenience. Since the handle 60, the partition plate 44, the first connection plate 40, the second connection plate 42, the bottom plate 12, the side plates 14A and 14B and the upper plate 16 are integrally formed, the carton 10 can be easily produced, and the number of parts is smaller than that of a carton in which each part is separately formed.

Figure 17:
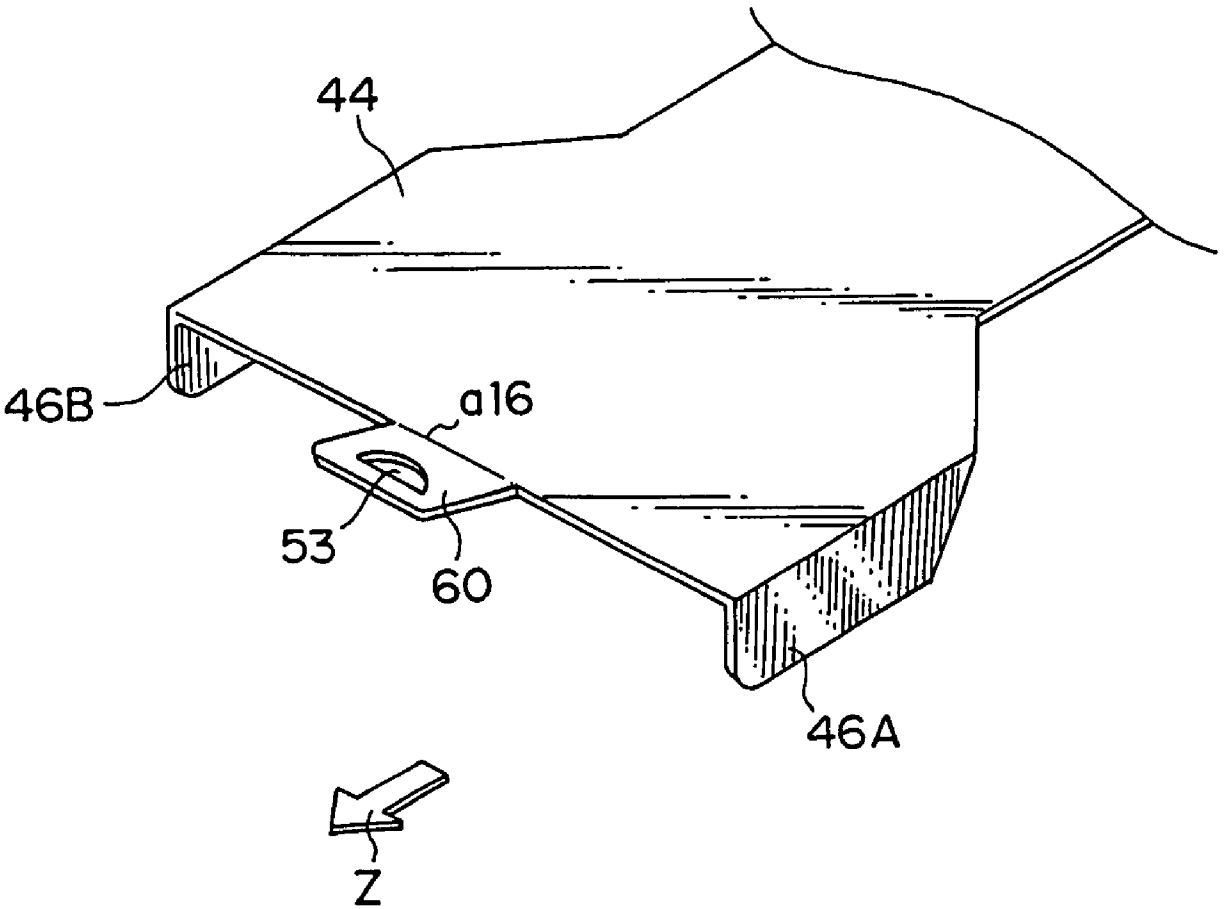
FIG. 17 is a perspective view showing a modification of a handle according to the second embodiment.

Although the handle 60 is rectangular in this embodiment, the shape of the handle is not limited to this shape, and may have other shapes. As shown in FIG. 17, a finger hole 53 can be formed in the handle 60. By providing the finger hole 53, a user can hook, for example, his/her finger here to pull the partition plate 44, and this increases convenience.

Figure 18:
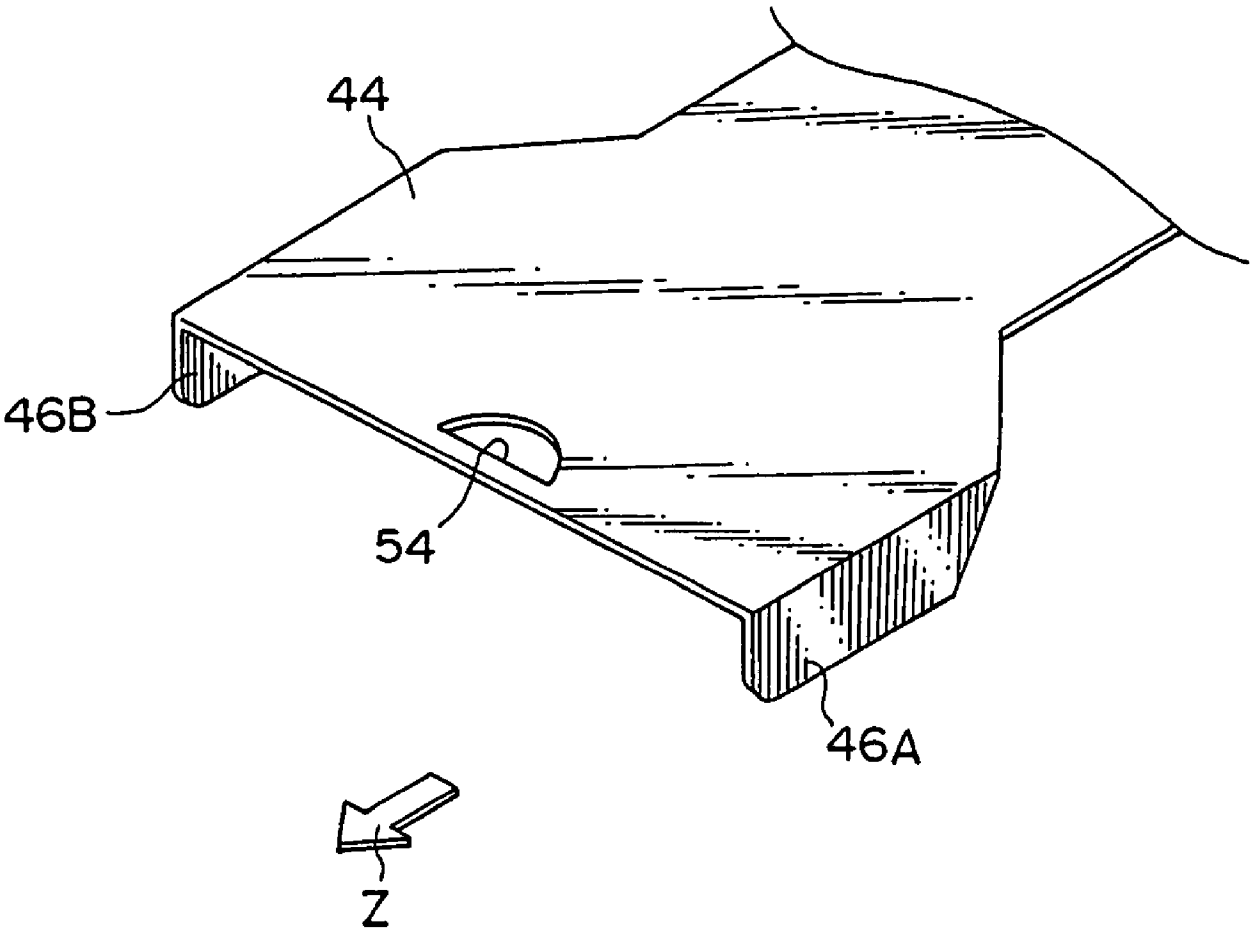
FIG. 18 is a perspective view showing another modification of the handle according to the second embodiment.

As shown in FIG. 18, a hole can be formed in an area at a front side of the partition plate 44 in direction Z, which area is not covered by the accommodated object, and a front-end surface of the partition plate 44 in direction Z facing this hole can serve as a handle 54. In this case, a user can pull the partition plate 44 with his/her finger hooked on the handle 54, and this increases convenience.

Figure 19:
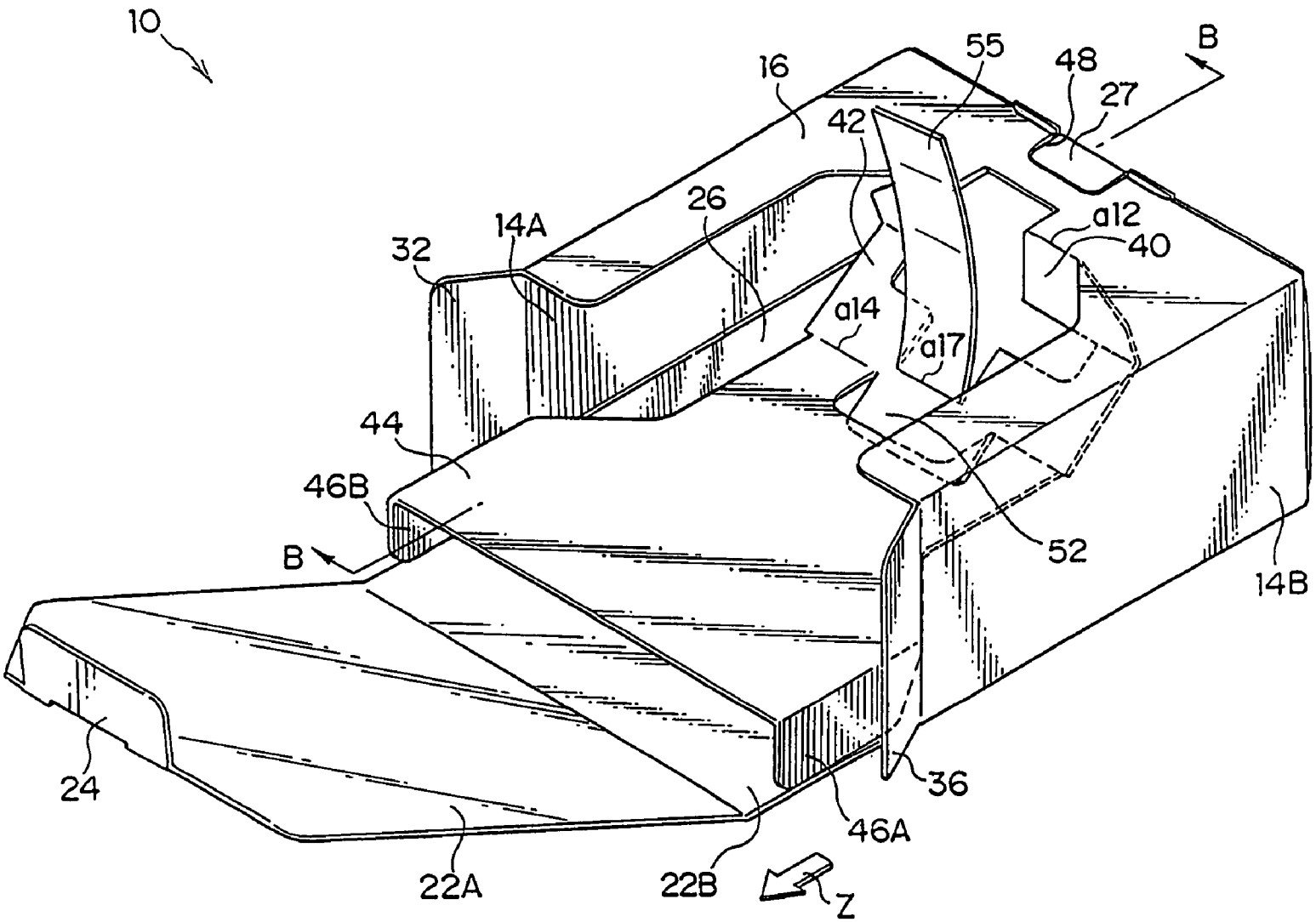
FIG. 19 is a perspective view showing yet another modification of the handle according to the second embodiment.
Figure 20:
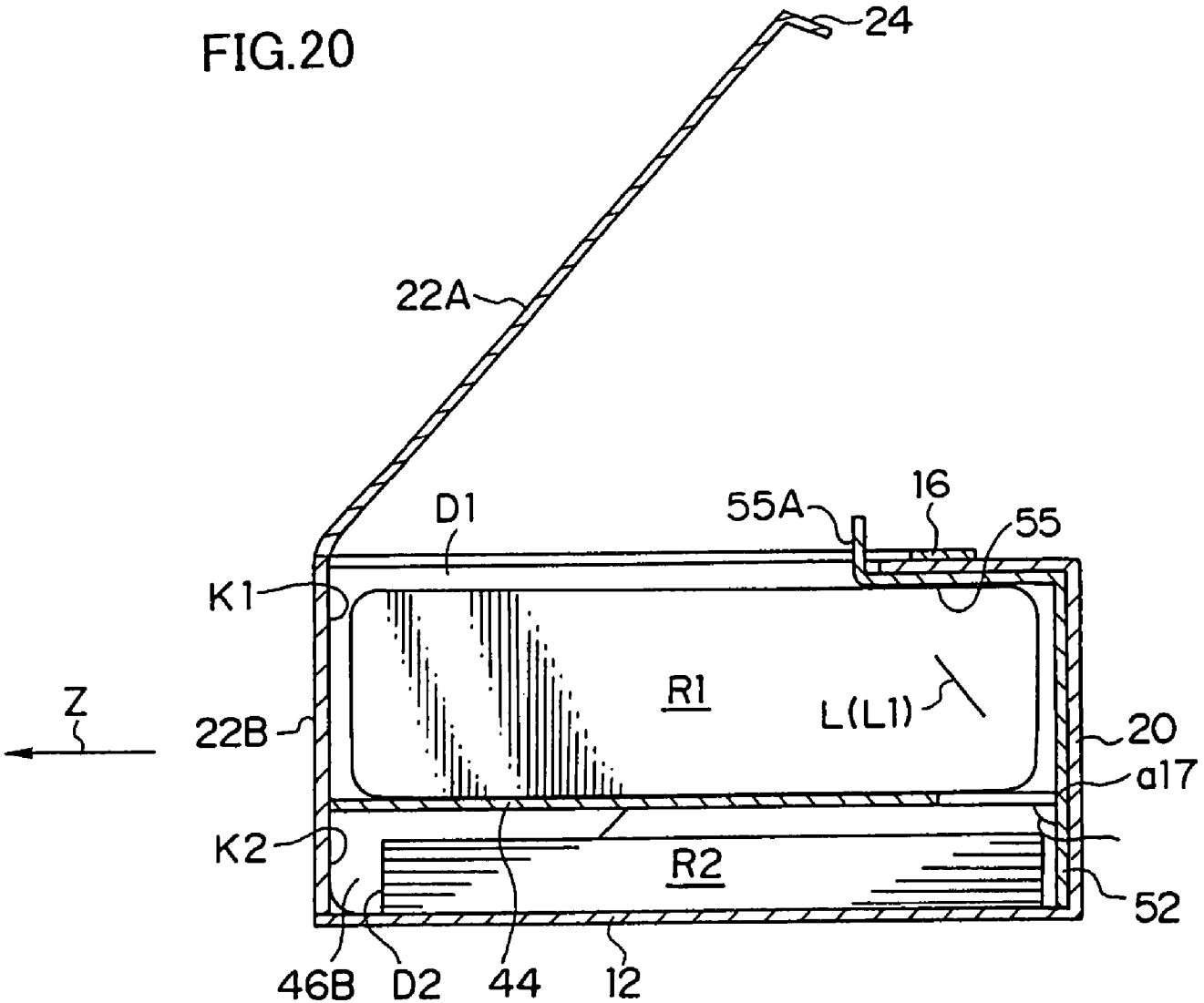
FIG. 20 is a sectional view showing still another modification of the handle according to the second embodiment.

Further, as shown in FIG. 19, a handle 55 may be formed, which is connected to the second connection plate 42 via a bend line a17. In this case, when the partition plate 44 is accommodated, as shown in FIG. 20, an end portion 55A of the handle 55 opposite to the bend line a17 projects from a plane of the upper plate 16. A user can pull the end portion 55A to move the partition plate 44 in direction Z. It should be noted that the handle 55 may be connected to the first connection plate 40.

Figure 21:
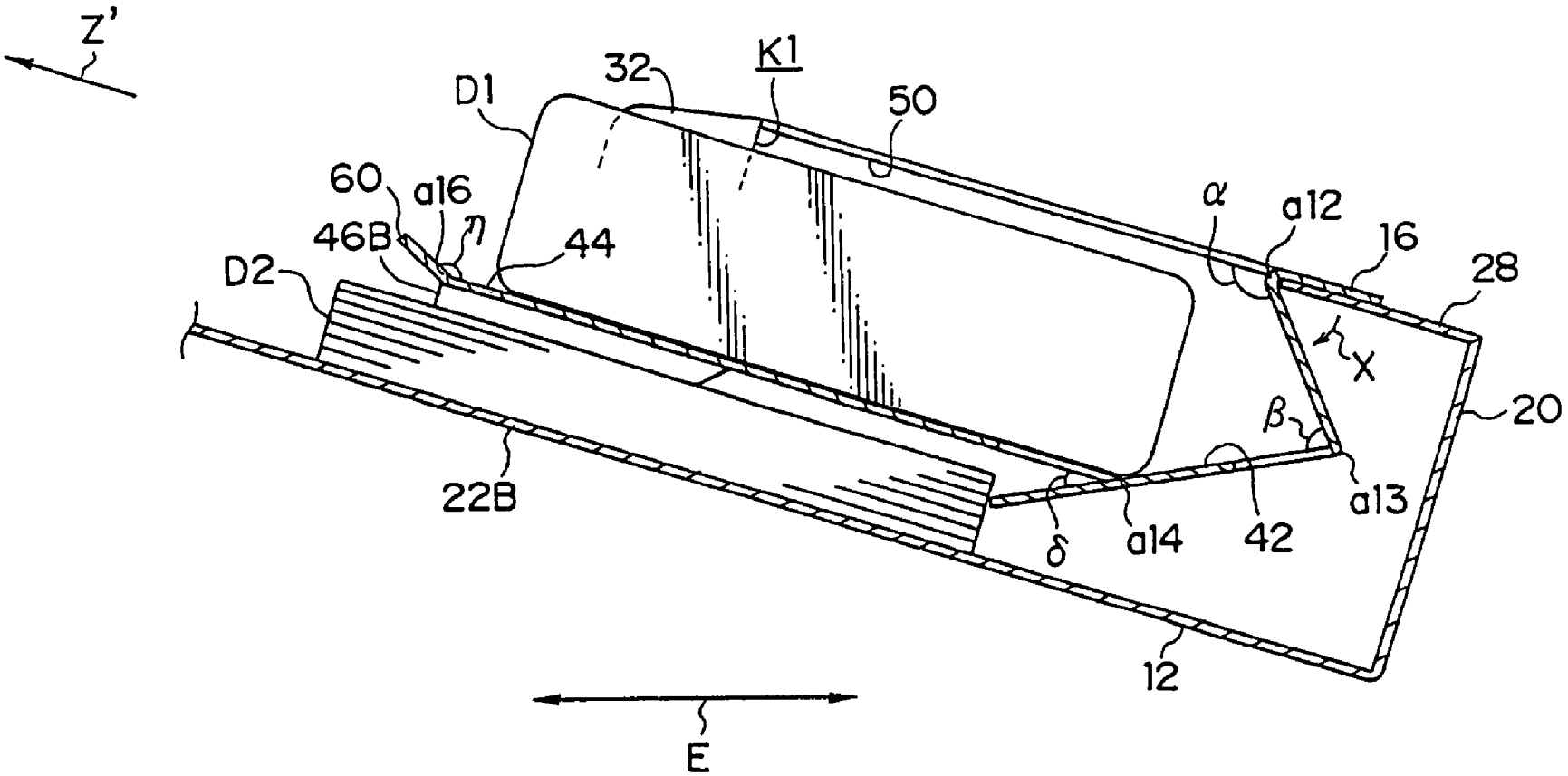
FIG. 21 is a sectional view showing the carton according to the second embodiment when it is inclined.

In the above-described example, the object D1 is placed on the horizontal partition plate 44 and is pulled out together with the partition plate 44. However, as shown in FIG. 21, for example, when the carton 100 is inclined with respect to a horizontal direction E and an opening K1 side of the plane of the partition plate 44 is higher than a cover plate 20 side thereof, the object D1 is pushed by the second connection plate 42 (see a portion around the bend line 14) and moved in direction Z'. In this case, the second connection plate 42 also serves as an object moving member.

Although the carton of this embodiment is formed as shown by the development of FIG. 11, the carton is not necessarily formed in this manner. For example, the side plate 14B and the upper plate 16 may be connected to the bottom plate 12 via the bend line b4, and the portion to be glued may be connected to the side plate 14A via the bend line b2. However, the carton can be efficiently formed according to the development of FIG. 11, leading to cost reduction.

The cover plates 22A and 22B are not essential, and the objects may be packaged with the openings K1 and K2 remaining open. However, by covering the openings K1 and K2 with the cover plates 22A and 22B as in this embodiment, the object is not exposed to the outside and thus can be protected. The cover plate 20 needs not be a cover which can be opened or closed, and may be fixed in a position perpendicular to the bottom plate 12 to serve as a part of the body of the carton.

The window 50 is not essential, and the upper plate 16 may be formed without the window 50. However, by providing the window 50 as in this embodiment, the object is easily seen from outside when the cover plates 22A and 22B are opened, allowing effective display of the object.

The object moving plate 52 is not essential, however, provision of the object moving plate 52 allows the object accommodated in the accommodation room R2 to be pulled out together with the partition plate 44, thereby increasing convenience. Further, since the end of the first connection plate 40 opposite to the second connection plate 42 is integrally connected to the upper plate 16 and the end of the second connection plate 42 opposite to the first connection plate 40 is integrally connected to the partition plate 44, the partition plate 44, the first connection plate 40, the second connection plate 42 and the body of the carton can be integrally formed. Thus, the carton 100 having the above-described effect can be easily produced and the number of parts can be reduced.

It should be noted that, unlike in this embodiment in which the object moving plate 52 pushes out the object, the object moving plate 52 may be disposed at an opening K2 side of the partition plate 44, and may engage with the object to fix the object to the partition plate 44. Further, the object moving plate 52 may be adapted to pull out the object by partially engaging with the object.

Third Embodiment

A third embodiment will now be described. Components that are similar to those in the first and the second embodiments are identified with the same reference numerals, and are not described in detail.

Figure 22:
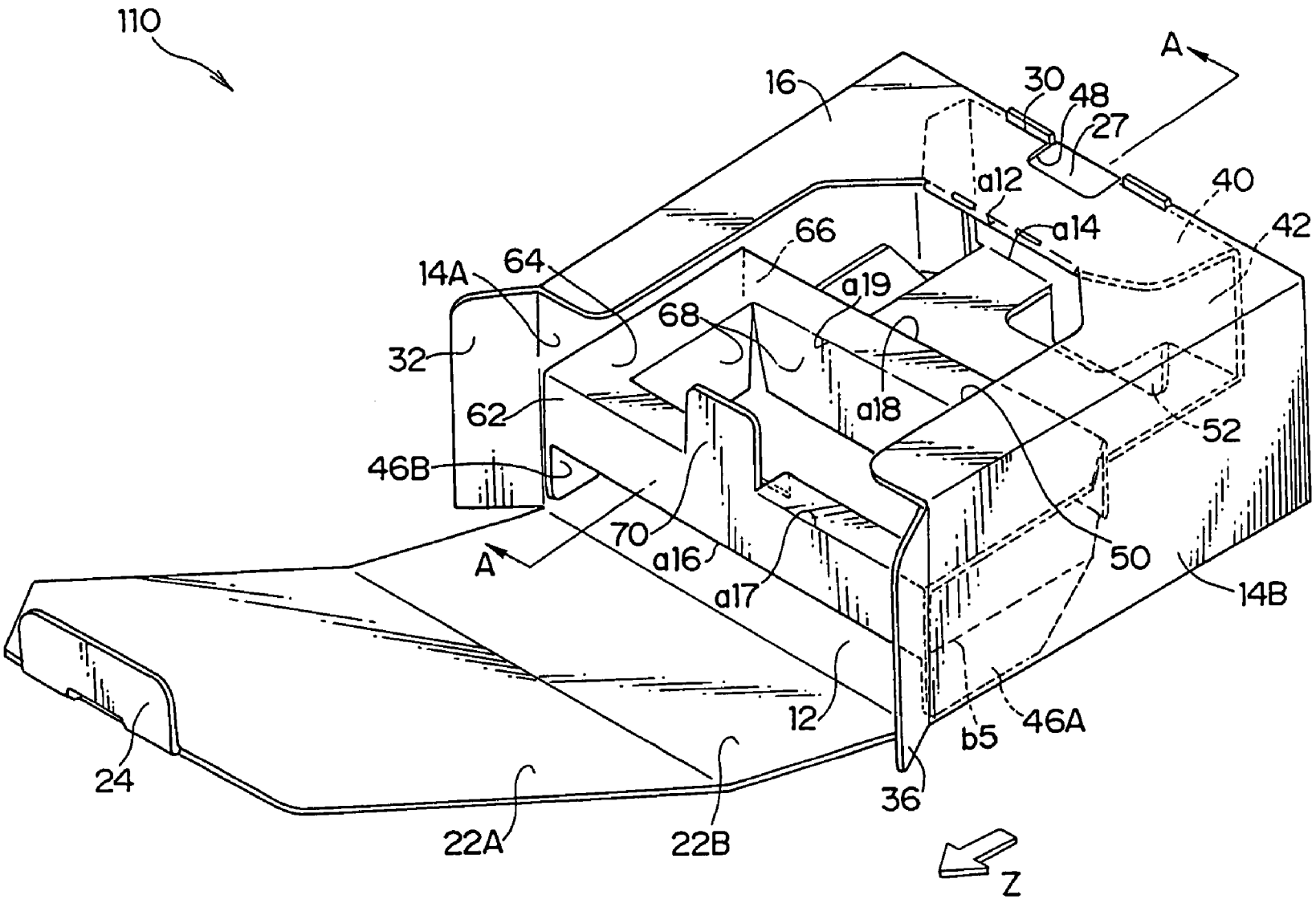
FIG. 22 is a perspective view showing a carton according to a third embodiment when a partition plate is accommodated.
Figure 23:
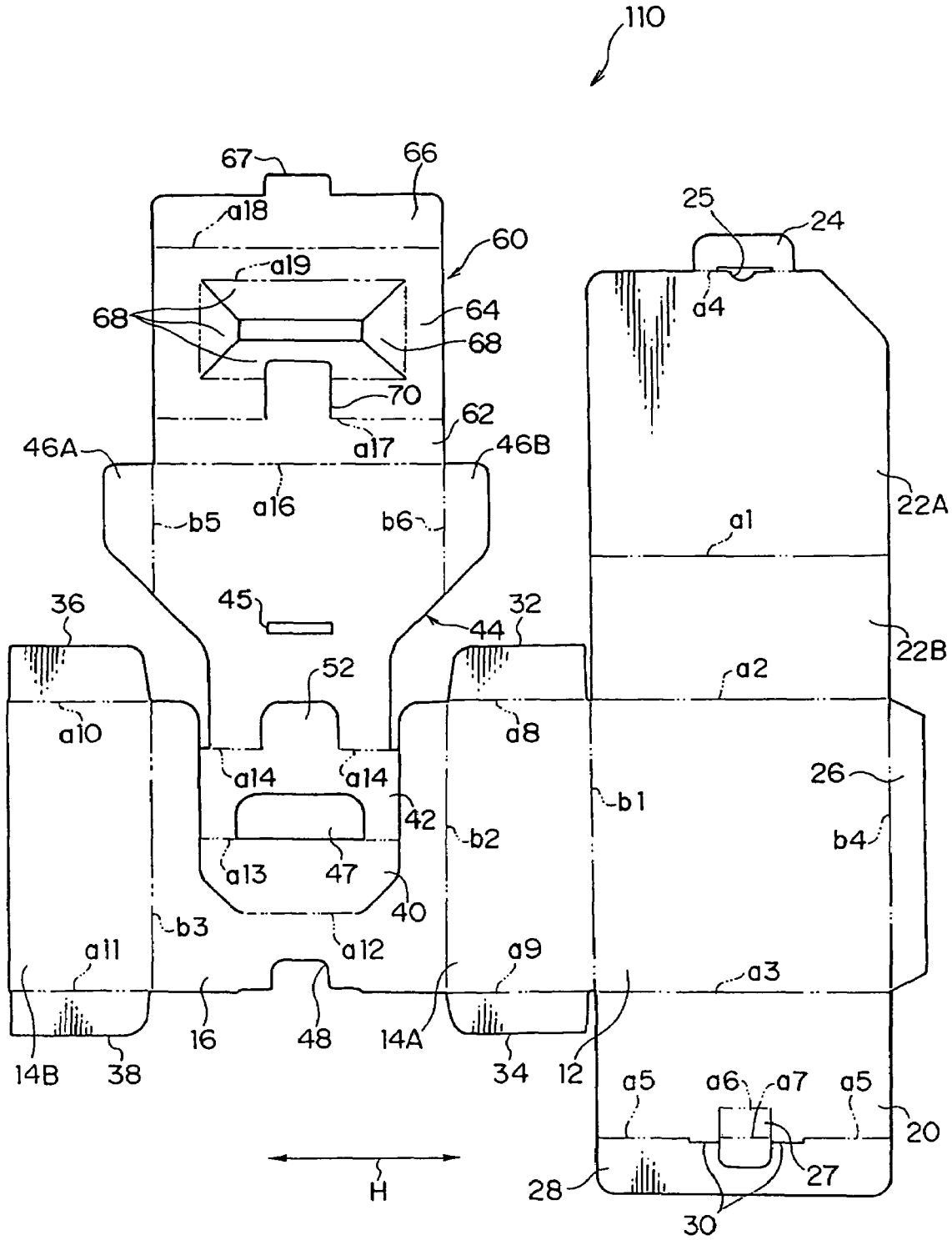
FIG. 23 is a development of the carton according to the third embodiment.

FIG. 22 is a perspective view of a carton 110 of this embodiment, and FIG. 23 is a development of the carton 110 showing a printed surface thereof.

As shown in FIG. 23, a buffer plate 60, the partition plate 44 and the connection plates including the second connection plate 42 and the first connection plate 40 are connected in this order in a direction perpendicular to direction H.

An insertion hole 45 is formed in the partition plate 44 at a substantially central portion thereof nearer to the bend line a14, and an insertion plate 67 (described later) can be inserted in the insertion hole 45.

As shown in FIG. 23, the buffer plate 60 is connected to an edge of the partition plate 44 along direction H via the bend line a16. The buffer plate 60 includes a first support 62, a buffer portion 64, a second support 66, the insertion plate 67, a holding portion 68 and a support/handle 70.

Figure 24:
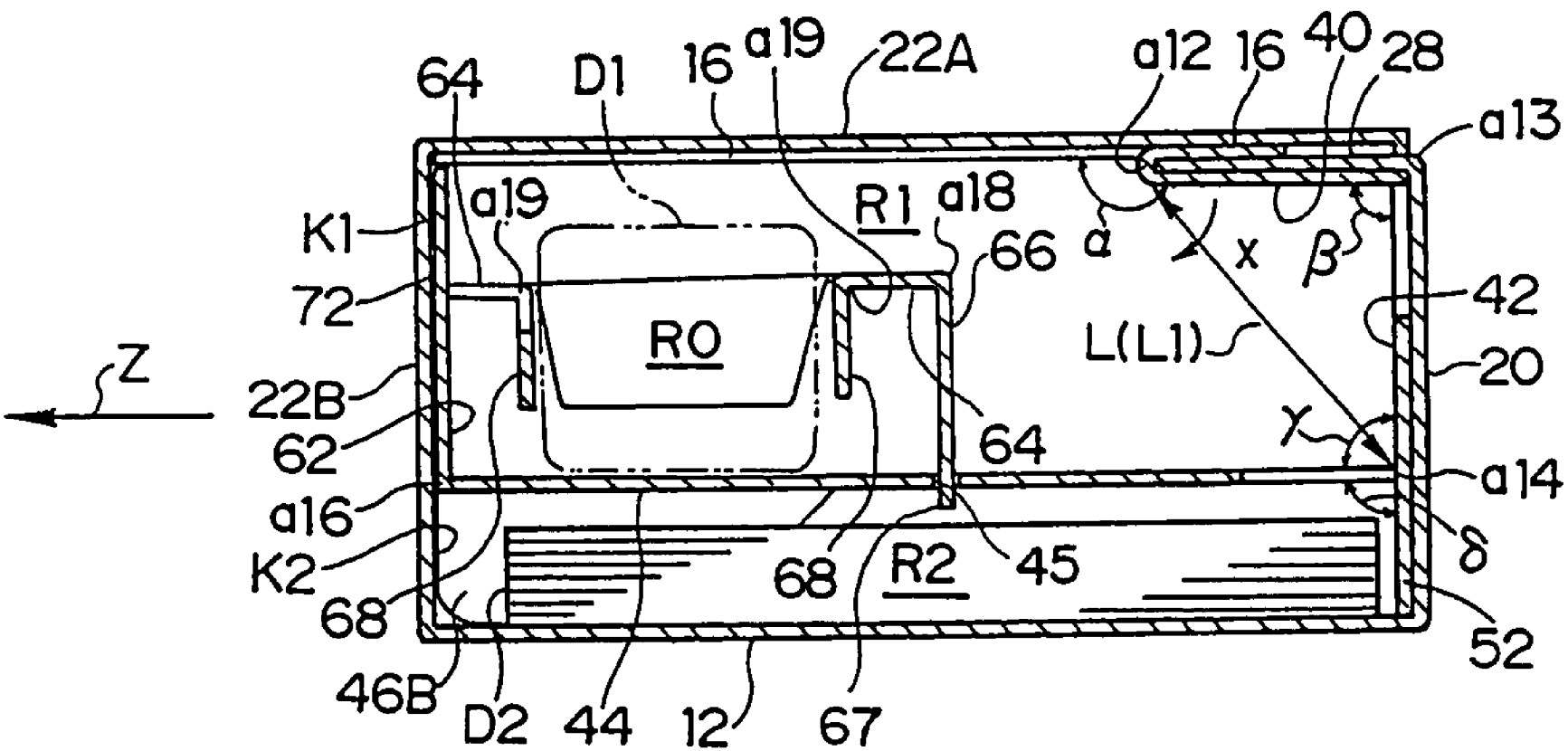
FIG. 24 is a sectional view taken along line A-A in FIG. 22, showing the carton in which objects are packaged.

The first support 62, the buffer portion 64, the second support 66 and the insertion plate 67 are connected in this order in the direction perpendicular to direction H. The first support 62 is connected to the partition plate 44 via the bend line a16, the buffer portion 64 is connected to the first support 62 via the bend line a17, and the second support 66 is connected to the buffer portion 64 via a bend line a18. As shown in FIGS. 22 and 24, the carton 110 is bent at the bend line a16 such that the printed surface faces inside and the partition plate 44 and the first support 62 are perpendicular to each other. At the bend line a17, the carton 110 is bent such that the printed surface faces inside and the first support 62 and the buffer portion 64 are perpendicular to each other. At the bend line a18, the carton 110 is bent such that the printed surface faces inside and the buffer portion 64 and the second support 66 are perpendicular to each other. In a state in which the partition plate is accommodated, the insertion plate 67 is inserted into the insertion hole 45. At this time, an edge of the second support 66 parallel to the bend line a18 abuts on the partition plate 44. Further, side edges of the second support 66 perpendicular to the bend line a18, as well as edges of the buffer portion 64 and the edges of the first support 62 (see FIG. 23), which are positioned on extended lines from the edges of the second support 66, respectively abut on the side plates 14A and 14B. The second support 66 is fixed by the insertion plate 67 inserted in the insertion hole 45.

As shown in FIG. 23, the holding portion 68 includes four plates, and is connected to the buffer portion 64 via a bend line a19, which is formed in a substantially rectangular shape at a central portion of the buffer portion 64. It should be noted that the holding portion 68 does not necessarily include four plates. Further, the holding portion 68 may not be provided, and the buffer portion 64 may only be provided with a hole formed along the bend line a19. As shown in FIG. 24, the carton 110 is bent at the bend line a19 such that the back surface faces outside and the buffer portion 64 and the holding portion 68 are substantially perpendicular to each other. As shown in FIG. 22, a section surrounded by the holding portion 68 and the partition plate 44 forms an accommodation section R0, in which the object D1 such as a digital camera can be accommodated. Therefore, the buffer portion 64 and the holding portion 68 are positioned between the object D1, accommodated in the accommodation section R0, and the side plates 14A and 14B and the closed cover plate 22B. The buffer portion 64 can alter its shape or position such that it deforms when being pressed by the object D1 accommodated in the accommodation section R0, or moves in the direction in which it is pressed, thereby effecting buffering.

As shown in FIG. 23, the support/handle 70 is connected to the first support 62 at a central portion of a buffer portion 64 side thereof. When the cover plate 22A is closed, the support/handle 70 abuts on the cover plate 22A to support the upper plate. The support/handle 70 and the first support 62 are coplanar.

The opening K1 is formed at a cover plate 22B side of the first accommodation room R1, and the object D1 accommodated in the accommodation section R0 can be put in or taken out through the opening K1. An opening K2 is formed at a cover plate 22B side of the second accommodation room R2, and the object D2 such as an manual can be put in or taken out through the opening K2.

Other portions are the same as those in the first and the second embodiments, and therefore, are not described in detail.

Next, operation of this embodiment is described.

As shown in FIG. 24, in a state in which the object D1 is accommodated in the accommodation section R0, the partition plate 44 is accommodated when the angle $\alpha$ is 180°, the angle $\beta$ is 90° and the angle $\gamma$ is 90°. At this time, the distance L between the bend line a12 and the bend line a14 is L1. The object D2 is accommodated in the accommodation room R2 through the opening K2. Then, the carton 110 is bent at the bend line a3 such that the back surface faces inside and the cover plate 20 and the bottom plate 12 are perpendicular to each other. Then, the lock plate 28 is inserted under the upper plate 16 to close the cover plate 20. Subsequently, the carton 110 is bent at the bend lines a1 and a2 such that the back surface faces inside and the cover plates 22A and 22B as well as adjacent plates are perpendicular to each other. Then, the lock plate 24 is inserted into the hole 30 to close the cover plates 22A and 22B. The lock plate 27 is bent at the bend line a7 at an angle of 90° such that the back surface faces inside, and the portion of the lock plate 27 from the tip thereof to the bend line a7 is inserted in the hole 25 to fix the cover plates 22A and 22B. Thus, packaging of the objects D1 and D2 is completed.

Even if an impact is applied to the carton 110 in this state, and at least one of the bottom plate 12, the side plates 14A and 14B, the cover plate 20 and the cover plate 22B is displaced inward, the buffer portion 64 and the holding portion 68, which are disposed between the object D1 and the bottom plate 12, the side plates 14A and 14B, the cover plate 20 and the cover plate 22B, cushion the impact applied to the object D1.

If the object D1 presses the holding portion 68 when an impact is applied, the holding portion 68 is displaced outward from the accommodation section R0 due to deformation or displacement of the buffer portion 64, or deformation or displacement of the holding portion 68 itself, thereby absorbing the impact applied to the object D1.

When the objects D1 and D2 are taken out from the package, the lock plate 27 is pulled out from the hole 25, the lock plate 24 is pulled out from the hole 30, and the cover plates 22A and 22B are opened.

Figure 25:
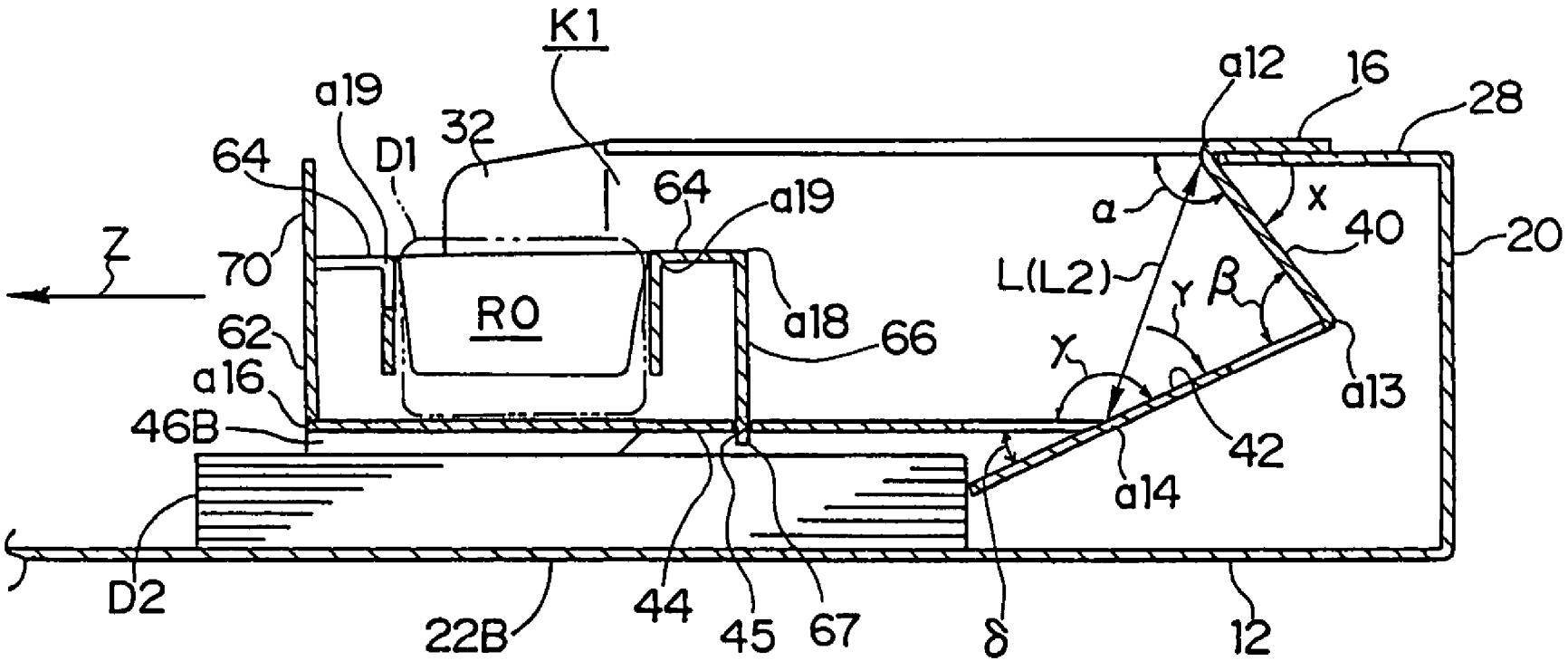
FIG. 25 is a sectional view taken along line B-B in FIG. 26, showing the carton in which objects are packaged.
Figure 26:
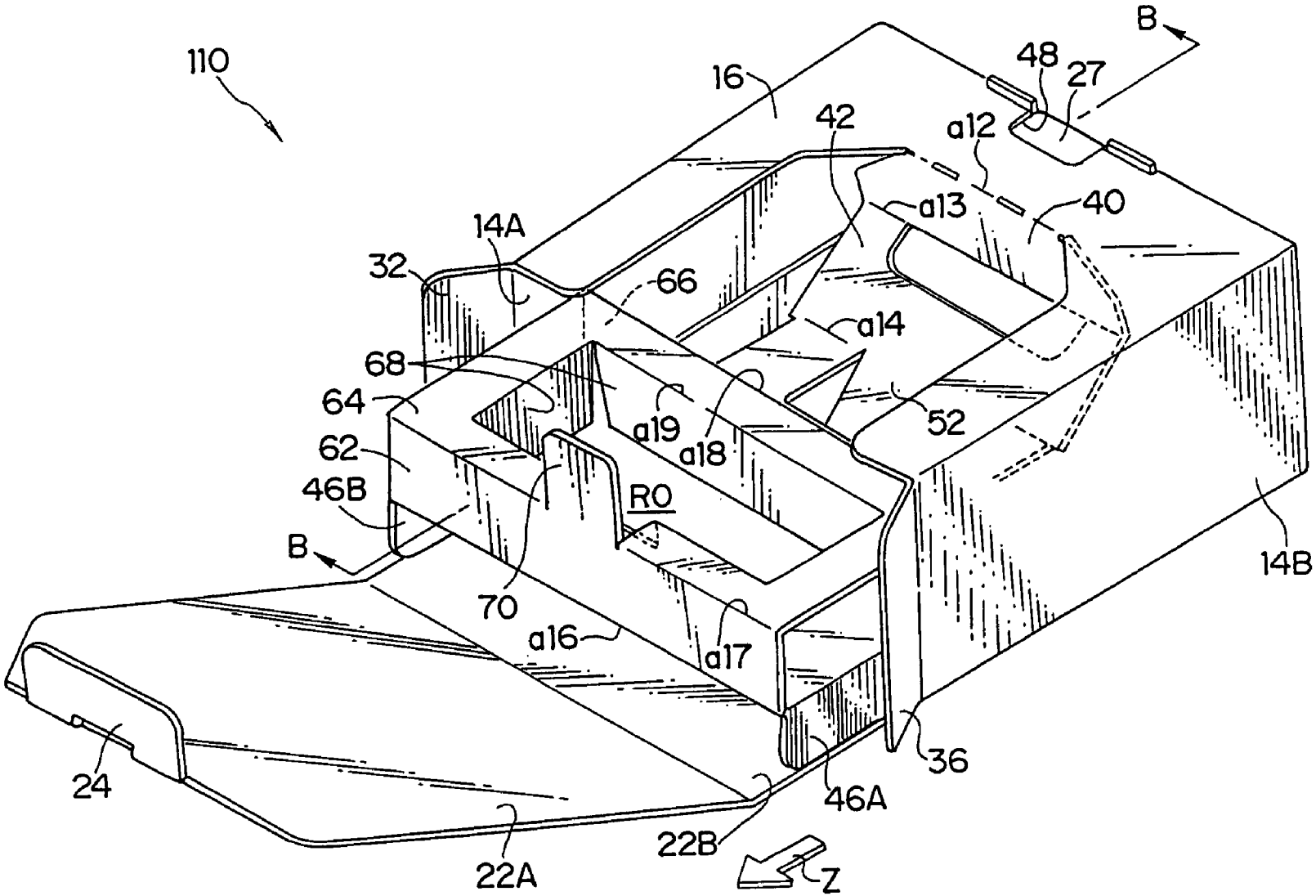
FIG. 26 is a perspective view showing the carton according to the third embodiment when the partition plate is pulled out by a small amount.

As shown in FIG. 25, as a force in direction Z along the plane of the partition plate outward from the openings K1 and K2 is applied to the support/handle 70, a force in the same direction is applied to the partition plate 44, and the first connection plate 40 rotates around the bend line a12 in direction X, decreasing the angle $\alpha$. The portion of the second connection plate 42 along the bend line a14 moves in direction Z, and the second connection plate 42 rotates in direction Y, increasing the angle γ. The portion of the object moving plate 52 along the bend line a14 moves in direction Z, and the object moving plate 52 rotates in direction Y, decreasing the angle δ. In this manner, as also shown in FIG. 26, the partition plate 44 is pulled out in direction Z, and the object D1 placed on the partition plate 44 is also pulled out together with the partition plate 44. As the object moving plate 52 moves in direction Z, the object D2 is pushed by the object moving plate 52 and moves in direction Z. At this time, as shown in FIG. 25, the distance L between the bend line a12 and the bend line a14 is L2 (L2<L1), which is shorter than that when the partition plate 44 is accommodated as described above.

Figure 27:
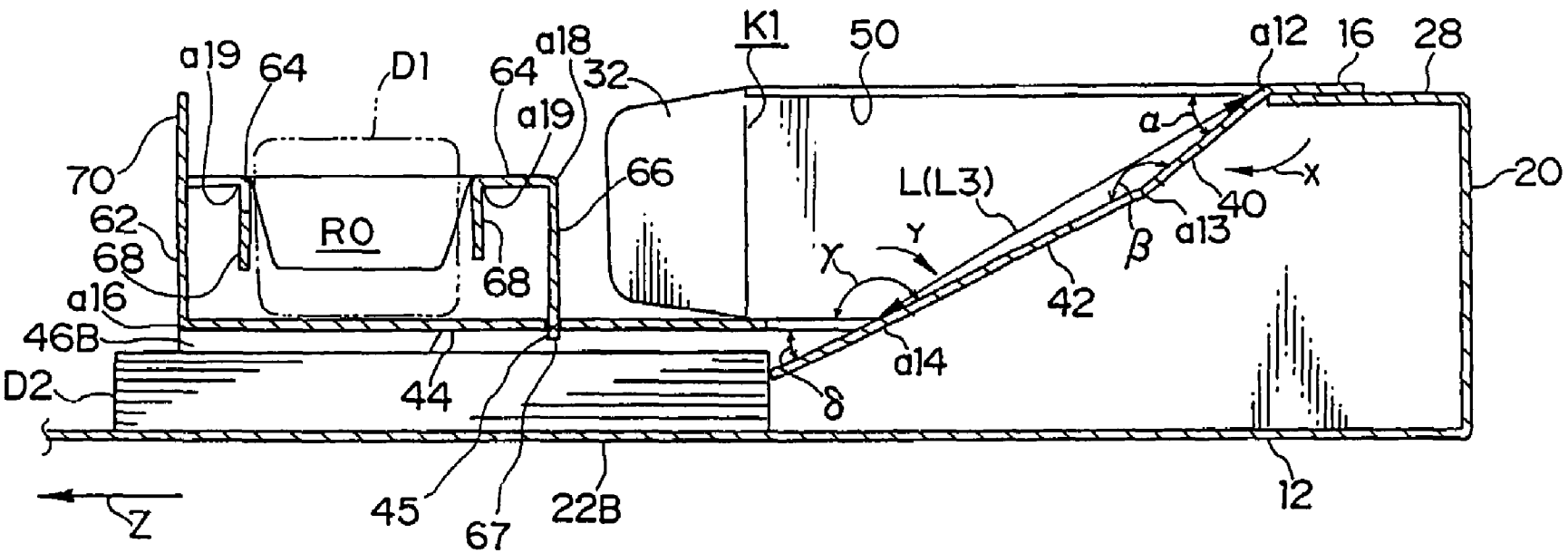
FIG. 27 is a sectional view taken along line C-C in FIG. 28, showing the carton in which objects are packaged.
Figure 28:
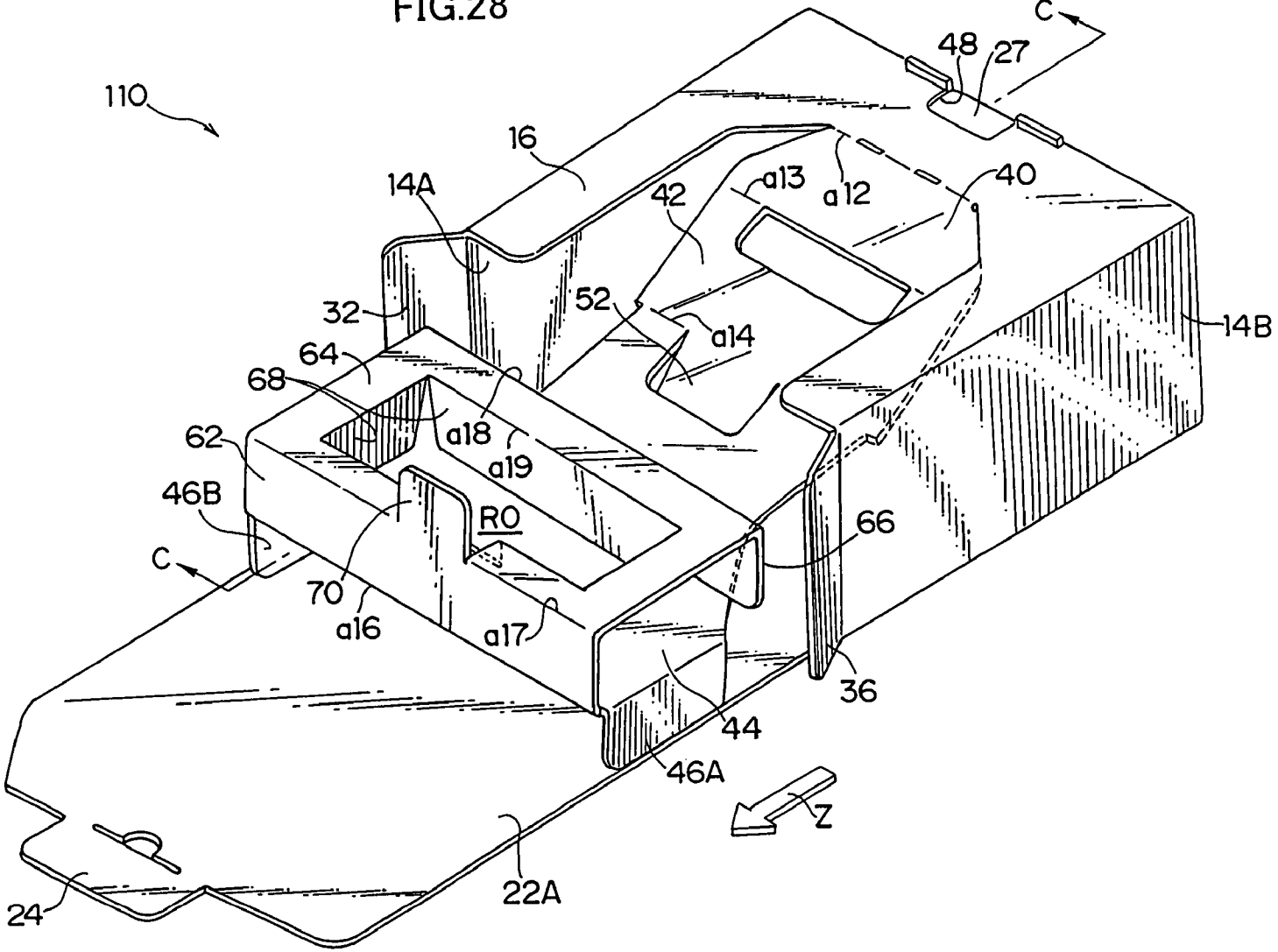
FIG. 28 is a perspective view showing the carton according to the third embodiment when the partition plate is completely pulled out.

As shown in FIG. 27, when the force in direction Z is further applied to the support/handle 70, the first connection plate 40 rotates around the bend line a12 in direction X, further decreasing the angle α. The portion of the second connection plate 42 along the bend line a14 moves further in direction Z, and the second connection plate 42 rotates in direction Y, further increasing the angle γ. Along with this, the angle β between the first connection plate 40 and the second connection plate 42 increases. The portion of the object moving plate 52 along the bend line a14 moves further in direction Z, and the object moving plate 52 rotates in direction Y, further decreasing the angle δ. In this manner, as also shown in FIG. 28, the partition plate 44 is pulled out in direction Z, and the object D1 placed on the partition plate 44 is also pulled out together with the partition plate 44. As the object moving plate 52 moves in direction Z, the object D2 is pushed by the object moving plate 52 and moves in direction Z. At this time, as shown in FIG. 27, the distance L between the bend line a12 and the bend line a14 is L3 (L2<L1<L3), which is longer than both of those when the partition plate 44 is accommodated and when the partition plate 44 is pulled out by a small amount.

In this state, the object D1 is completely out of the openings K1 and K2, and can be easily taken out from the package by being lifted up in a direction perpendicular to the buffer portion 64.

Since the carton 110 according to this embodiment includes the buffer portion 64 and the holding portion 68, for example, even if an impact is applied to the object D1, a buffering effect can be obtained and the object D1 can be protected.

When the object D1 is packaged with being placed on the partition plate 44, the object D1 can be easily taken out from the package by moving the object D1 and the partition plate 44 outward from the opening, i.e., in direction Z, thereby increasing convenience. In addition, since the buffer plate 60, the support/handle 70 the partition plate 44, the first connection plate 40, the second connection plate 42, the bottom plate 12, the side plates 14A and 14B, and the upper plate 16 are integrally formed, the carton 110 can be easily produced, and the number of parts is smaller than that in a carton in which each part is separately formed.

Figure 29:
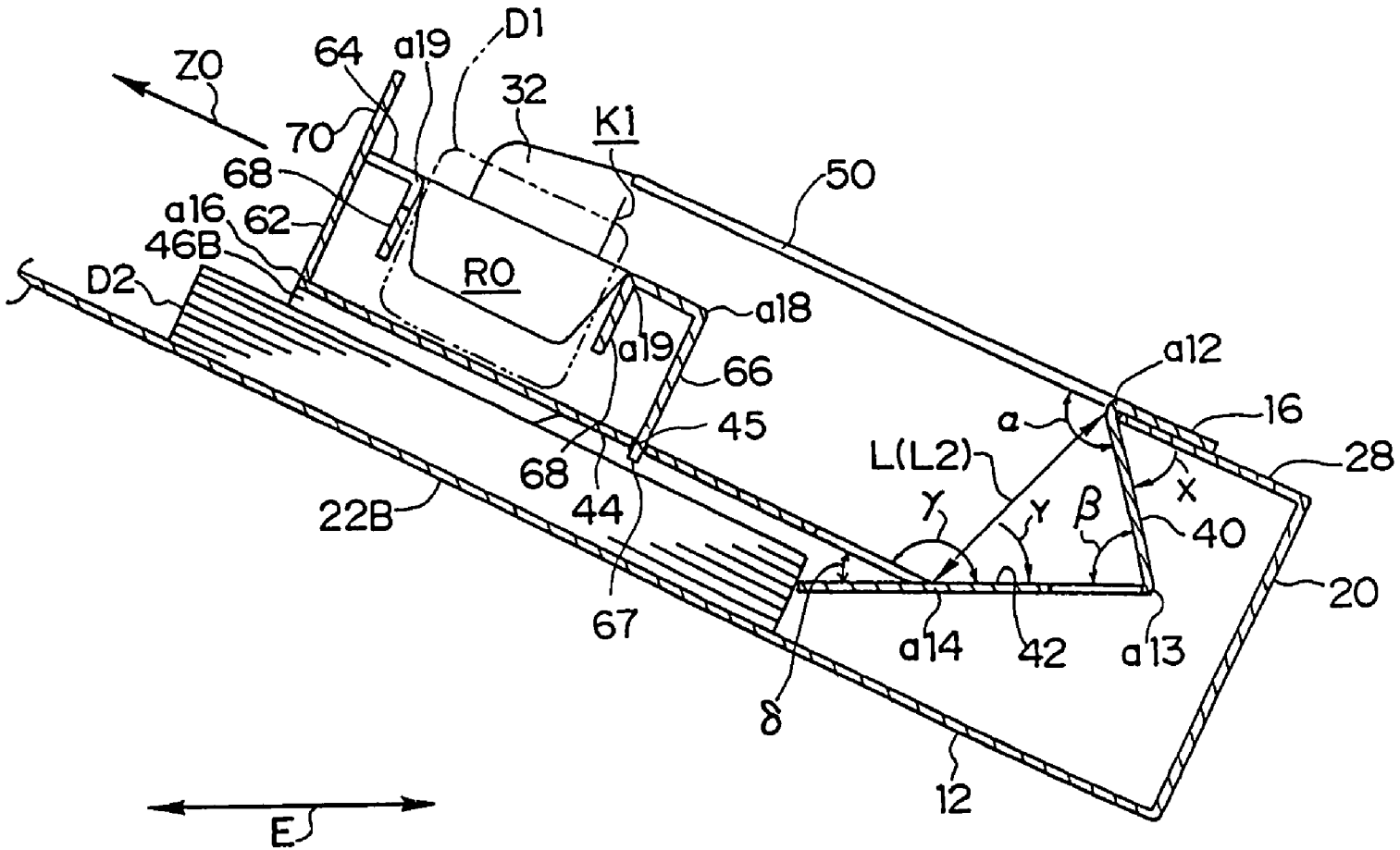
FIG. 29 is a sectional view showing the carton according to the third embodiment when it is inclined.

In the above-described example, the object D1 is placed on the horizontal partition plate 44 and is pulled out together with the partition plate 44. However, as shown in FIG. 29, for example, when the carton 110 is inclined with respect to a horizontal direction E and an opening K1 side of the plane of the partition plate 44 is higher than a cover plate 20 side thereof, the object D1 is pushed by the second connection plate 42 (see a portion around the bend line 14) and moved in direction Z0. In this case, the second connection plate 42 also serves as an object moving member.

Although the carton of this embodiment is formed as shown by the development of FIG. 23, the carton is not necessarily formed in this manner. For example, the side plate 14B and the upper plate 16 may be connected to the bottom plate 12 via the bend line b4, and the portion to be glued 26 may be connected to the side plate 14A via the bend line b2. However, the carton can be efficiently formed according to the development of FIG. 23, leading to cost reduction.

The cover plates 22A and 22B are not essential, and the objects may be packaged with the openings K1 and K2 remaining open. However, by covering the openings K1 and K2 with the cover plates 22A and 22B as in this embodiment, the object is not exposed to the outside and thus can be protected. The cover plate 20 needs not be a cover which can be opened or closed, and may be fixed in a position perpendicular to the bottom plate 12 to serve as a part of the body of the carton.

The window 50 is not essential, and the upper plate 16 may be formed without the window 50. However, by providing the window 50 as in this embodiment, the object is easily seen from outside when the cover plates 22A and 22B are opened, allowing effective display of the object.

The object moving plate 52 is not essential, however, provision of the object moving plate 52 allows the object accommodated in the accommodation room R2 to be pulled out together with the partition plate 44, thereby increasing convenience. Further, since the end of the first connection plate 40 opposite to the second connection plate 42 is integrally connected to the upper plate 16 and the end of the second connection plate 42 opposite to the first connection plate 40 is integrally connected to the partition plate 44, the partition plate 44, the first connection plate 40, the second connection plate 42 and the body of the carton can be integrally formed. Thus, the carton 100 having the above-described effect can be easily produced and the number of parts can be reduced.

It should be noted that, unlike in this embodiment in which the object moving plate 52 pushes out the object, the object moving plate 52 may be disposed at an opening K2 side of the partition plate 44, and may engage with the object to fix the object to the partition plate 44. Further, the object moving plate 52 may be adapted to pull out the object by partially engaging with the object.

Fourth Embodiment

A fourth embodiment will now be described. Components that are similar to those in the first to the third embodiments are identified with the same reference numerals, and are not described in detail.

Figure 30:
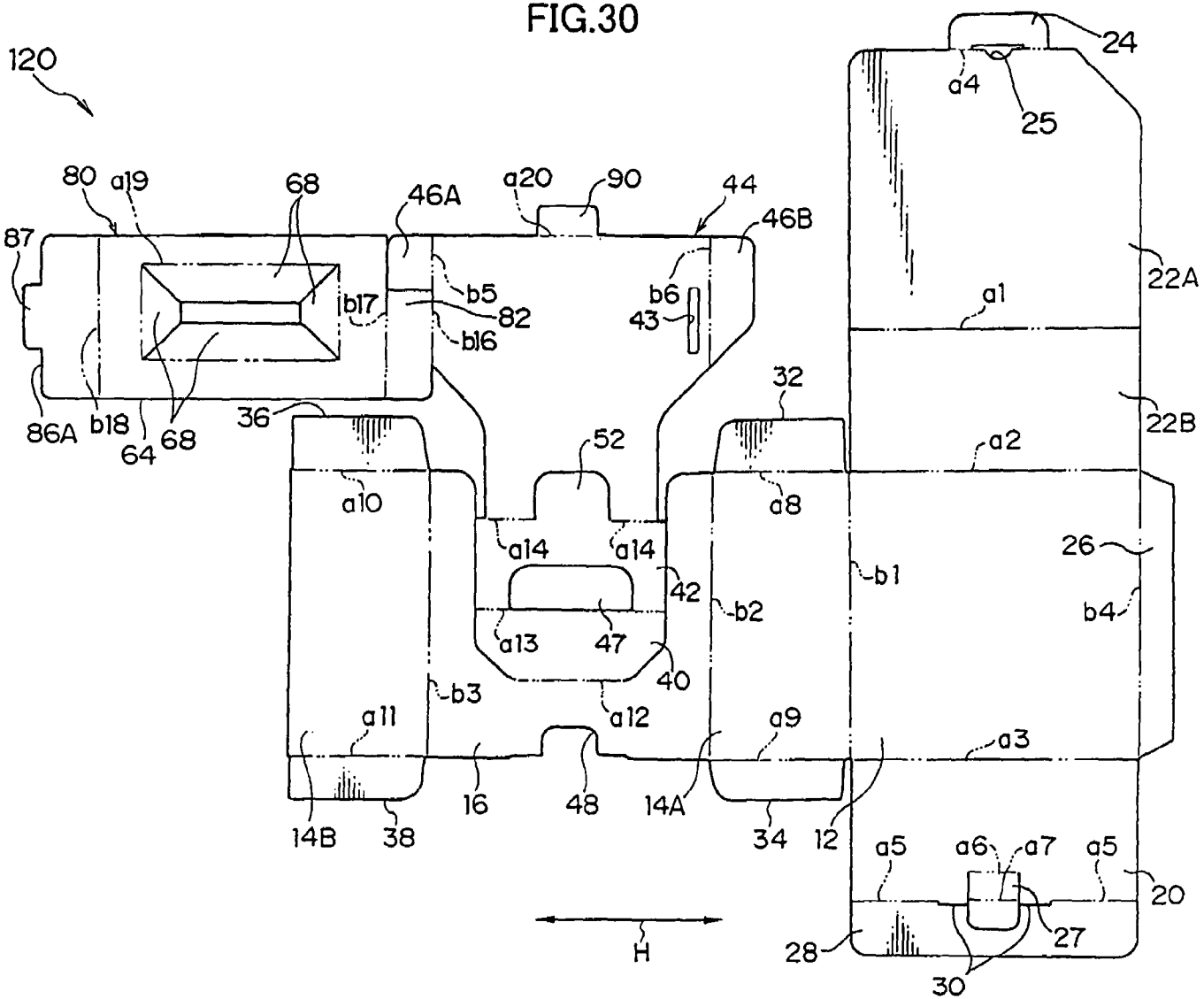
FIG. 30 is a development of a carton according to a fourth embodiment.
Figure 31:
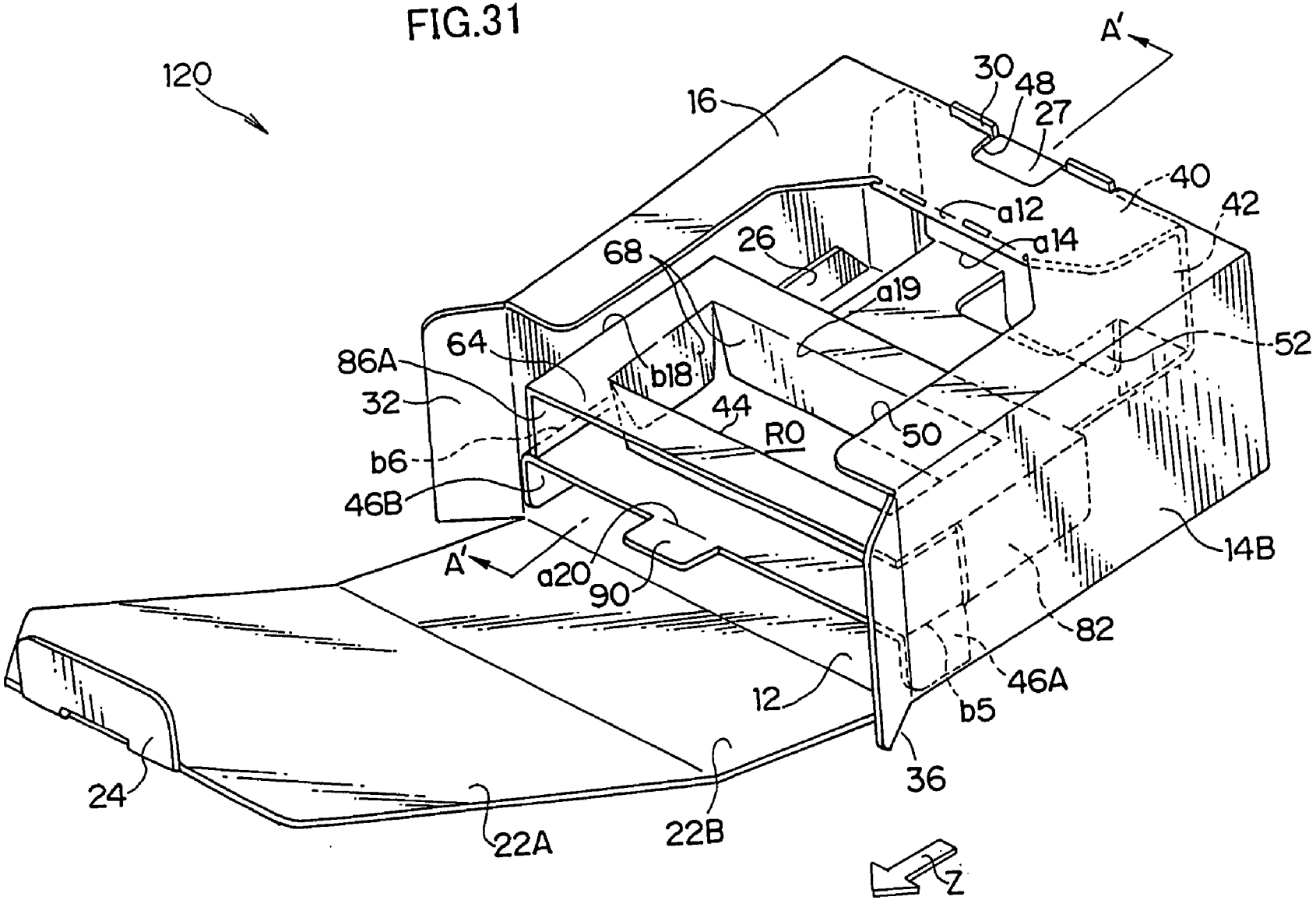
FIG. 31 is a perspective view showing the carton according to the fourth embodiment when a partition plate is accommodated.
Figure 32:
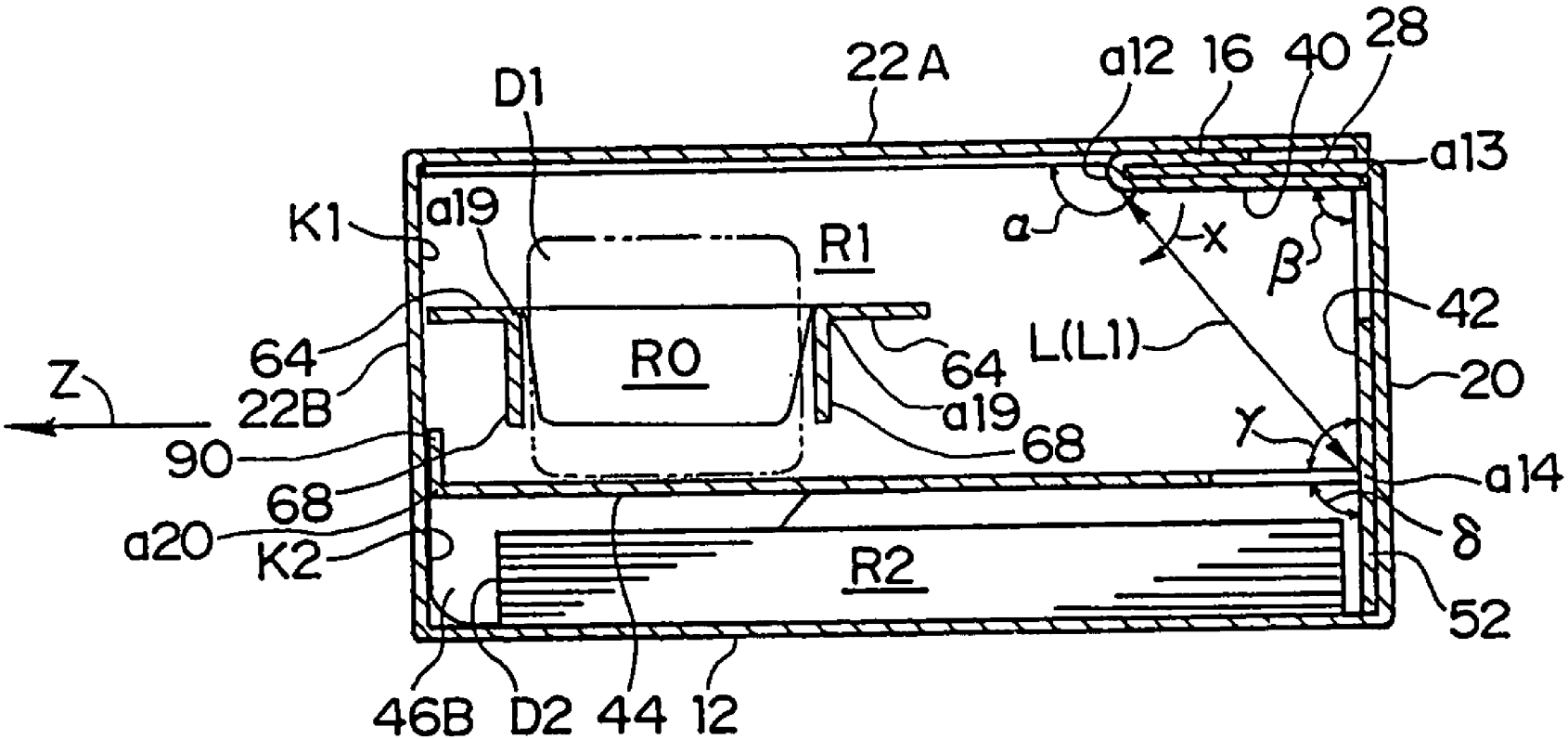
FIG. 32 is a sectional view taken along line A'-A' in FIG. 31, showing the carton in which objects are packaged.

As shown in FIG. 30, a carton 120 of this embodiment includes a buffer plate 80. The buffer plate 80 is connected to the partition plate 44 at an edge thereof opposite to the cover plate 22A in a direction perpendicular to the direction H, and includes a first support 82, the buffer portion 64, a second support 86A, an insertion plate 87, a holding portion 68 and a support/handle 90. The first support 82, the buffer portion 64, the second support 86A and the insertion plate 87 are connected in this order in direction H. The first support 82 is connected to the partition plate 44 via the bend line b1, the buffer portion 64 is connected to the first support 82 via a bend line b17, and the second support 86A is connected to the buffer portion 64 via a bend line b18. As shown in FIGS. 31 and 32, the carton 120 is bend at a bend line b16 such that the printed surface faces inside and the partition plate 44 and the first support 82 are perpendicular to each other. At the bend line b17, the carton 120 is bent such that the printed surface faces inside and the first support 82 and the buffer portion 64 are perpendicular to each other. At the bend line a18, the carton 120 is bent such that the printed surface faces inside and the buffer portion 64 and the second support 86A are perpendicular to each other. An insertion hole 43 is formed in the partition plate 44 in a position along the bend line b6, and the insertion plate 87 can be inserted in the insertion hole 43. In a state in which the partition plate is accommodated, the insertion plate 87 is inserted into the insertion hole 43. At this time, an edge of the second support 86A in a direction perpendicular to direction H abuts on the upper plate 16. A back surface of the second support 86A abuts on the side plate 14A. The second support 86A is fixed by the insertion plate 87 inserted in the insertion hole 43.

As shown in FIG. 30, the support/handle 90 is connected to the partition plate 44 at a central portion of an edge thereof along direction H via a bend line a20. The carton 120 is bent at the bend line a20 such that the printed surface faces inside. It should be noted that the carton 120 may be bent at the bend line a20 such that the printed surface faces outside.

Similarly to the third embodiment, when a force in direction Z along the plane of the partition plate outward from the openings K1 and K2 is applied to the support/handle 90, the partition plate 44 moves in direction Z and is pulled out.

The carton 120 of this embodiment can provide effects similar to those in the third embodiment.

It should be noted that, although the cartons 110 and 120 of the third and the fourth embodiments respectively include the support/handles 70 and 90, the support/handles 70 and 90 are not essential. However, by providing the support/handle 70 or 90, a user can grasp the support/handle 70 or 90 to apply force in direction Z thereto. In this manner, the user can move the partition plate along the plane of the partition plate outward from the opening more easily than when the support/handle 70 or 90 is not provided.

Figure 33:
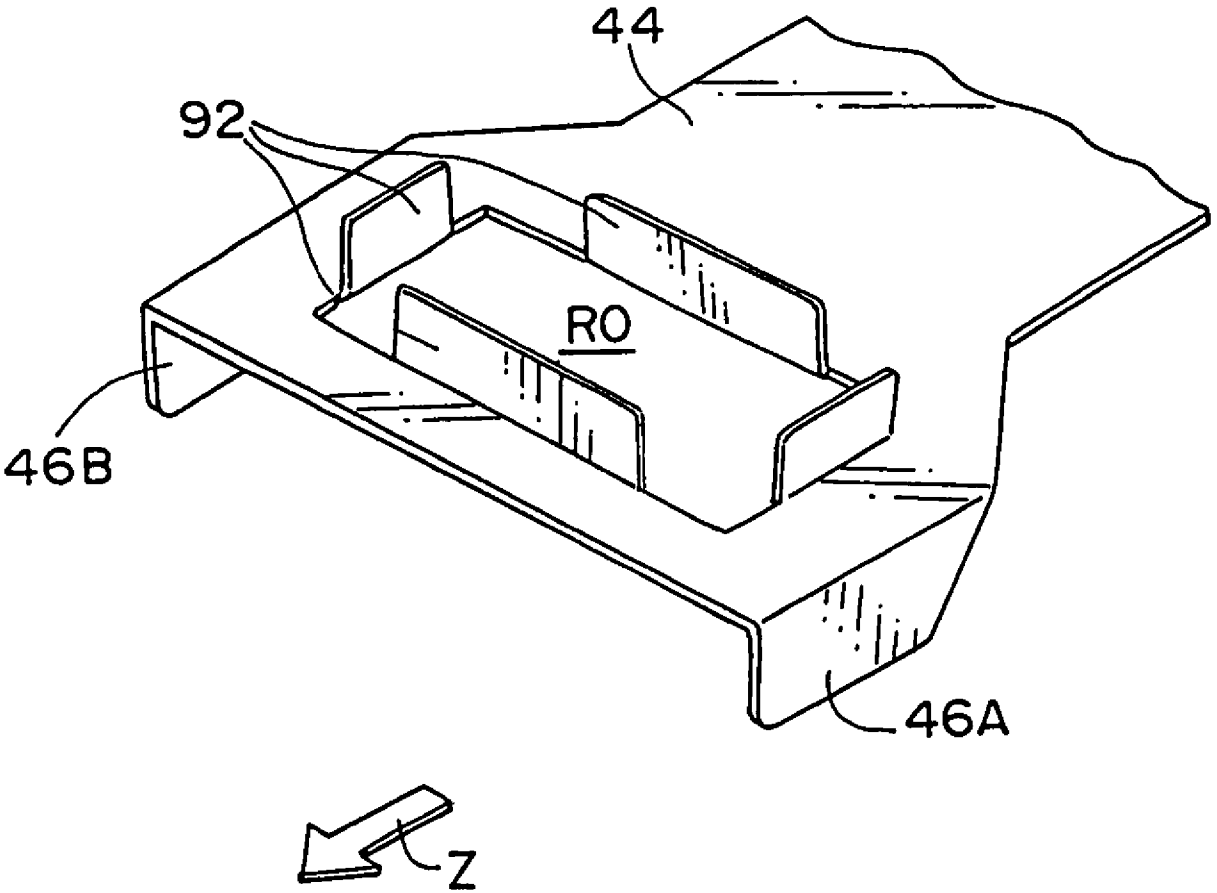
FIG. 33 is a perspective view showing a modification of the partition plate according to the third and the fourth embodiments.

In the third and the fourth embodiments, the buffer plates 60 and 80 are connected to the edge of the partition plate 44. However, as shown in FIG. 33, a hole may be formed in the partition plate 44 at a central portion of the surface thereof, in which the object D1 can be inserted, and buffer plates 92 may be provided.

What is claimed is:

1. A carton comprising:

a carton body having an opening through which an object to be packaged can be put in and taken out;

a partition plate formed in a plate shape for partitioning a space surrounded by the carton body into a plurality of rooms, the partition plate being movable along a plane thereof outward from the opening, where the partition plate is outwardly slidable along a plane that remains parallel to the partition plate;

a buffer plate connected integrally with the partition plate and disposed between the object accommodated in at least one of the rooms and the carton body, the buffer plate capable of deformation when pressed by the object; and a connection plate comprising a first connecting portion integrally connected to the carton body and a second connecting portion integrally connected to the partition plate, an angle between the first connecting portion and the second connecting portion being changeable during sliding movement of the partition plate.

2. The carton according to claim 1, wherein the carton body, the partition plate, the buffer plate and the connection plate are formed from a single plate.

3. The carton according to claim 1, further comprising an object moving member integrally connected to at least one of the partition plate and the connection plate, for moving the object accommodated in at least one of the rooms along with movement of the partition plate.

4. The carton according to claim 2, further comprising an object moving member integrally connected to at least one of the partition plate and the connection plate, for moving the object accommodated in at least one of the rooms along with movement of the partition plate, wherein the object moving member is formed from the same single plate from which the carton body, the partition plate, the buffer plate and the connection plate are formed.

5. The carton according to claim 1, further comprising a cover integrally connected to the carton body, for covering the opening.

6. The carton according to claim 2, further comprising a cover integrally connected to the carton body, for covering the opening, wherein the cover is formed from the same single plate from which the carton body, the partition plate, the buffer plate and the connection plate are formed.

7. The carton according to claim 3, further comprising a cover integrally connected to the carton body, for covering the opening.

8. The carton according to claim 1, further comprising supporting plates integrally connected to the partition plate, the supporting plates supporting the partition plate by bending in a direction perpendicular to the partition plate, and end portions of the supporting plates touching a bottom plate of the carton body.

* * * * *